US008680463B2

(12) United States Patent
Loboda

(10) Patent No.: US 8,680,463 B2
(45) Date of Patent: Mar. 25, 2014

(54) LINEAR ION TRAP FOR RADIAL AMPLITUDE ASSISTED TRANSFER

(75) Inventor: Alexandre Loboda, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 13/813,881

(22) PCT Filed: Aug. 3, 2011

(86) PCT No.: PCT/CA2011/000889

§ 371 (c)(1), (2), (4) Date: Jul. 12, 2013

(87) PCT Pub. No.: WO2012/016330

PCT Pub. Date: Feb. 9, 2012

(65) Prior Publication Data

US 2013/0299689 A1 Nov. 14, 2013

Related U.S. Application Data

(60) Provisional application No. 61/370,492, filed on Aug. 4, 2010.

(51) Int. Cl.
*H01J 49/26* (2006.01)

(52) U.S. Cl.
USPC ..... 250/283; 250/281; 250/288

(58) Field of Classification Search
USPC ..... 250/281, 282, 283, 286, 287, 288
See application file for complete search history.

(56) References Cited

U.S. PATENT DOCUMENTS

2009/0008543 A1* 1/2009 Reinhold ..... 250/282
2013/0221242 A1* 8/2013 Green et al. ..... 250/489

* cited by examiner

*Primary Examiner* — Nicole Ippolito

(57) ABSTRACT

Systems, methods and apparatus for radial amplitude assisted transfer (RAAT) in mass spectrometers are provided in which ions for RAAT are accelerated along a longitudinal axis of a mass spectrometer in order to decrease the magnitude of excitation energy of radially excited ions in an ion trap that allows the radially excited ions to exit the ion trap. Hence, the radially excited ions exit the ion trap with reduced radial energy thereby decreasing the exit angle of the radially exited ions from the ion trap. Furthermore, combined forces on the ions are such that radially excited ions exit the ion trap while unexcited ions remain in the ion trap.

20 Claims, 25 Drawing Sheets

LINEAR ION TRAP FOR RADIAL AMPLITUDE ASSISTED TRANSFER

CROSS REFERENCE TO RELATED APPLICATIONS

This application is a National Stage filing under 35 U.S.C. §371 of PCT/CA2011/000889 filed on Aug. 3, 2011, which designated the U.S., and which claims the benefit of U.S. Provisional Application Ser. No. 61/370,492 filed on Aug. 4, 2010, the contents of which are incorporated herein by reference in their entireties.

FIELD

The specification relates generally to mass spectrometers, and specifically to a linear ion trap for radial amplitude assisted transfer.

BACKGROUND

Mass selective axial ejection (MSAE) is a technique used in linear ion guides of mass spectrometers to select and eject ions along the axis by applying a radial excitation. Ions are trapped radially by an RF (radio-frequency) quadrupole field and axially by static DC (direct current) potentials applied at the ends of the ion guide. An axial force arises due to a pseudo-potential that develops axially at the fringe region of the ion guide, that is dependent on the amplitude of radial excitation. When the amplitude is high, radially excited ions are ejected.

BRIEF DESCRIPTIONS OF THE DRAWINGS

Implementations are described with reference to the following figures, in which.

DETAILED DESCRIPTION OF THE IMPLEMENTATIONS

Figure 1:
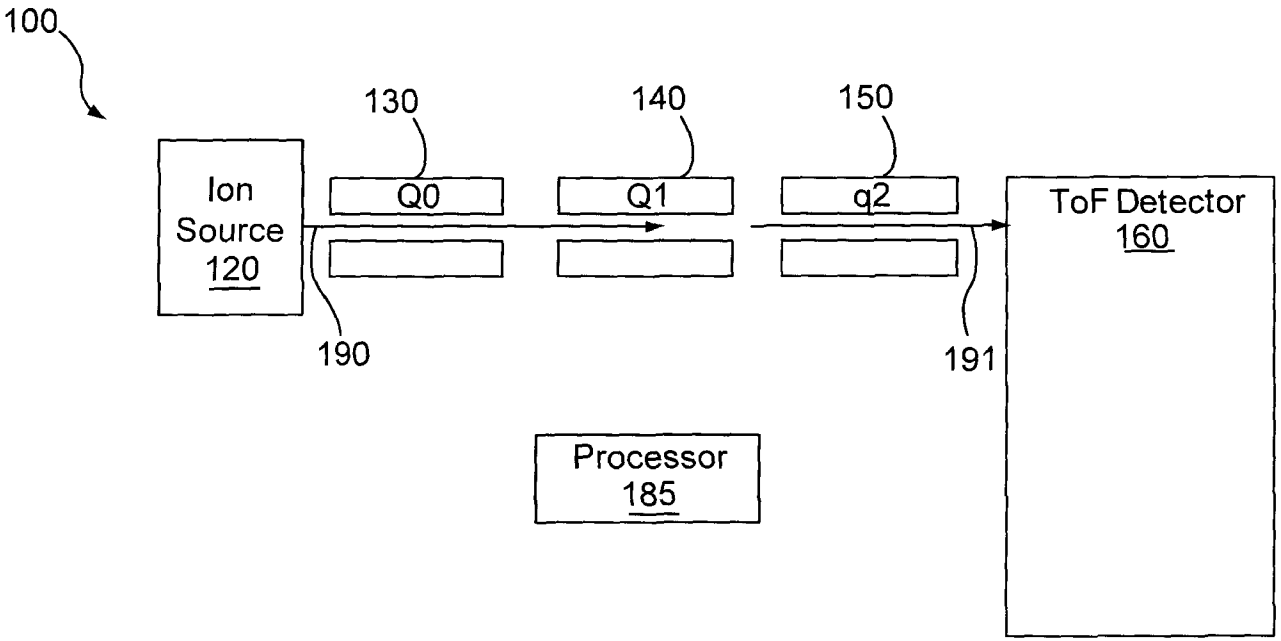
FIG. 1 depicts a block diagram of a mass spectrometer, according to non-limiting implementations.

A first aspect of the specification provides a mass spectrometer for radial amplitude assisted transfer (RAAT), the mass spectrometer comprising: an ion source; a first axial acceleration region for axially accelerating at least a portion of the ions from the ion source along a longitudinal axis of the mass spectrometer; at least one linear ion trap arranged to receive the ions from the ion source, the at least one linear ion trap comprising: an entrance region for receiving the ions therein; an exit region for transferring radially exited ions out of the at least one linear ion trap; at least one DC (direct current) electrode for applying a DC potential barrier to prevent unexcited ions from exiting the at least one linear ion trap; a radial excitation region between the entrance region and the exit region for selective radial excitation of the ions trapped in the at least one linear ion trap thereby producing the radially excited ions; a second axial acceleration region for further accelerating the radially excited ions along the longitudinal axis towards the exit region due to a pseudo-potential produced by a reduction in RF field strength, such that a combined effect of forces on the radially excited ions due to the first axial acceleration region and the second axial acceleration region causes the radially excited ions to overcome the DC potential barrier while the unexcited ions which are not radially excited remain in the at least one linear ion trap. The mass spectrometer further comprises a detection device for receiving and analyzing at least a portion of the radially excited ions that exit the at least one linear ion trap.

The first axial acceleration region can be located between the ion source and the at least one linear ion trap, acceleration in the first axial region occurring by providing a longitudinal DC potential to the at least a portion of the ions.

The first axial acceleration region can be located in the at least one linear ion trap, prior to the exit region, acceleration in the first axial region can occur by at least one of: providing a difference in the RF field in the first axial acceleration region to generate there a pseudo-potential longitudinal axial force on the radially excited ions; and providing a longitudinal DC potential in the first axial acceleration. Providing the difference in the RF field can comprise providing an RF gradient in the first acceleration region. The at least one ion trap can comprise RF electrodes, a radial distance between the RF electrodes increasing in the first axial acceleration region such that the providing the difference in the RF field occurs due to a change in the distance. The distance between the RF electrodes can be due to a change in shape of the RF electrodes. The RF electrodes are at least one of: decreasing in diameter in the first axial acceleration region; tapered in the first axial acceleration region; and stepped in the first axial acceleration region.

The first acceleration region can be between the radial excitation region and the exit region, and the at least one linear ion trap can comprise a first set of RF electrodes in the radial excitation region and a second set of electrodes in the first acceleration region, the second set RF electrodes electrically connected to the first set of RF electrodes via a circuit which causes a change in the RF field between the radial excitation region and the first acceleration region such that the difference in the RF field is caused by the change. In other words, axial acceleration of radially excited ions is due to the pseudo-potential force resulting from the change in RF field The second axial acceleration region can be adjacent to the exit region, and the at least one DC electrode can be located adjacent to the exit region.

The second axial acceleration region can be located between the first acceleration, and the exit region the at least one DC electrode can be located between the first acceleration and the exit region.

The radial excitation region can comprise at least one set of RF electrodes for producing the radially excited ions and at least one set of DC electrodes for providing the longitudinal DC potential. The second axial acceleration region can be adjacent to the exit region, and the at least one DC electrode can also be located adjacent to the exit region. A distance between the at least one set of DC electrodes can increase from an entrance end of the DC electrodes to an exit end of the DC electrodes thereby providing the longitudinal DC potential. Each of the at least one set of DC electrodes can comprise a series of opposed DC electrodes for producing the longitudinal DC potential, the series of opposed DC electrodes independently controlled to apply the longitudinal DC potential to the ions as DC potential steps in each successive electrode in the series.

The radial excitation region can comprise the first axial acceleration region, and a longitudinal axial force on the radially excited ions can be due to segmented RF electrodes in the radial excitation region, the segmented RF electrodes each having a respective applied DC voltage which decreases from an entrance end of the radial acceleration region to an exit end of the radial acceleration region.

The radial excitation region can comprises the first axial acceleration region, a longitudinal axial force on the radially excited ions due to resistive coatings on RF electrodes in the radial acceleration region.

The first axial acceleration region can be between the radial excitation region and the end trap, wherein providing the difference in longitudinal DC potential in the first axial acceleration region can comprise: applying a first DC potential in the first axial acceleration region for trapping the ions in the radial acceleration region during selective radial excitation, the first DC potential greater than a DC potential in the radial excitation region; and, applying a second DC potential in the first axial acceleration region less than the first DC potential and less than the DC potential in the radial excitation region, such that ions in the radial excitation region are accelerated through the first axial acceleration region and the combination of forces on the radially excited ions due to the longitudinal DC potential and the pseudo-potential causes the radially excited ions to overcome the DC potential barrier. The radial excitation region can comprise at least one set of RF electrodes for producing the radially excited ions and at least one set of DC electrodes for providing a decreasing DC potential, and wherein, prior to applying the second DC potential, the decreasing DC potential is applied in the radial excitation region hence applying an additional accelerating force on the radially excited ions.

The at least one linear ion trap can be enabled to produce the radially excited ions via at least one of: an AC (alternating current) field; bringing an RF voltage near an instability threshold for selected ions; and increasing the RF voltage to or above the instability threshold for a duration of excitation and then lowering the RF voltage.

The second axial acceleration region can be at least one of adjacent to the exit region and before the exit region.

A second aspect of the specification provides a method for radial amplitude assisted transfer (RAAT) in a mass spectrometer, the method comprising: producing ions in an ion source; axially accelerating at least a portion of the ions along a longitudinal axis of the mass spectrometer, in a first axial acceleration region; and applying a pseudo-potential in a second axial acceleration region to radially excited ions in an ion trap, the pseudo-potential produced by a reduction in RF field strength, such that a combined effect of forces on the radially excited ions due to the first axial acceleration region and the second axial acceleration region causes the radially excited ions to overcome a DC (direct current) potential barrier while unexcited ions which are not radially excited remain in the at least one linear ion trap, the linear ion trap arranged to receive the ions from the ion source, the at least one linear ion trap comprising: an entrance region for receiving the ions therein; an exit region for transferring radially exited ions out of the at least one linear ion trap, at least one DC electrode for applying the DC potential barrier to prevent the unexcited ions from exiting the at least one linear ion trap; a radial excitation region between the entrance region and the exit region for selective radial excitation of the ions trapped in the at least one linear ion trap thereby producing the radially excited ions. The method further comprises analyzing at least a portion of the radially excited ions at a detection device.

The at least one linear ion trap can be enabled to produce the radially excited ions via at least one of: an AC (accelerating current) field; bringing an RF voltage near an instability threshold for selected ions; and increasing the RF voltage for a duration of excitation and then lowering the RF voltage.

A third aspect of the specification provides a method for radial amplitude assisted transfer (RAAT) in a mass spectrometer, the method comprising: injecting ions from an ion source into a linear ion trap enabled for RAAT; radially exciting at least a portion of the ions to produce radially excited ions in the linear ion trap; accelerating at least one of the ions and the radially excited ions along a longitudinal axis of the mass spectrometer, wherein the accelerating occurs at least one of prior to the radially exciting step and after the radially exciting step; and further accelerating the radially excited ions along the longitudinal axis due to a pseudo-potential produced by a reduction in RF field strength, such that a combination of forces on the radially excited ions due to the accelerating step and the further accelerating causes the radially excited ions to overcome a DC potential barrier can comprise and exit the linear ion trap while the ions which are not radially excited remain in the linear ion trap.

The accelerating step can occur prior to the radially exciting step. The accelerating step can further occur between the ion source and the linear ion trap.

The accelerating step can occur by at least one of: providing a difference in an RF field in the linear ion trap prior to the exit region to generate there between a pseudo-potential longitudinal axial force on the radially excited ions; and providing a longitudinal DC potential on the at least one of the ions and the radially excited ions. Providing the difference in the RF field can comprise providing an RF gradient by at least one of: an increasing radial distance between RF electrodes in the linear ion trap; a change in shape of the RF electrodes; a decrease in diameter of the RF electrodes in at least a first portion of the linear ion trap; the RF electrodes being tapered in at least a second portion of the linear ion trap; the RF electrodes being stepped in at least a third portion of the linear ion trap; and the linear ion trap comprising a first set of RF electrodes and at least a second set of electrodes adjacent the exit region, the second set RF electrodes electrically connected to the first set of RF electrodes via a circuit which causes the difference in the RF field.

Providing the longitudinal DC potential can occur by increasing a distance between at least one set of DC electrodes that extend longitudinally in the linear ion trap.

Providing the longitudinal DC potential can occur by providing a series of opposed DC electrodes that extend longitudinally in the linear ion trap, the series of opposed DC electrodes for producing the longitudinal DC potential, the series of opposed DC electrodes independently controlled to apply the longitudinal DC potential to the ions as DC potential steps in each successive electrode in the series.

The radial excitation region can comprise the first axial acceleration region, and a longitudinal axial force on the radially excited ions can be due to segmented RF electrodes in the radial excitation region, the segmented RF electrodes each having a respective applied DC voltage which decreases from an entrance end of the radial acceleration region to an exit end of the radial acceleration region.

The radial excitation region can comprise the first axial acceleration region, a longitudinal axial force on the radially excited ions due to resistive coatings on RF electrodes in the radial acceleration region.

The method can further comprise extracting the radially excited ions from the linear ion trap by: applying a first DC potential adjacent the exit region for trapping the ions in a radial acceleration region of the linear ion trap during selective radial excitation, the first DC potential greater than a DC potential in the radial excitation region; and, applying a second DC potential adjacent the exit region, the second DC potential less than the first DC potential and less than the DC potential in the radial excitation region, such that ions in the radial excitation region are accelerated to the exit region and the combination of forces on the radially excited ions due to the longitudinal DC potential and the pseudo-potential causes the radially excited ions to overcome the DC potential barrier. The method can further comprise, prior to applying the second DC potential, applying a decreasing DC potential in the radial excitation region hence applying an additional accelerating force on the radially excited ions.

A fourth aspect of the specification provides a mass spectrometer for radial amplitude assisted transfer (RAAT), the mass spectrometer comprising: an ion source; at least one linear ion trap arranged to receive the ions from the ion source, the at least one linear ion trap comprising: an entrance region for receiving the ions therein; an exit region for transferring radially exited ions out of the at least one linear ion trap; at least one DC (direct current) electrode for applying a DC potential barrier to prevent unexcited ions from exiting the at least one linear ion trap; a radial excitation region between the entrance region and the exit region for selective radial excitation of the ions trapped in the linear ion trap thereby producing radially excited ions via application of an AC (alternating current) field; an axial acceleration region between the radial excitation region and an exit of the at least one linear ion trap, the axial acceleration region for axially accelerating at least a portion of the ions from the ion source along a longitudinal axis of the mass spectrometer by providing a difference in the RF field in the axial acceleration region to generate there a pseudo-potential longitudinal axial force on the radially excited ions, the difference in the RF field provided by an RF gradient from least one of: an increasing distance between RF electrodes in the at least one linear ion trap; a change in shape of the RF electrodes; a decrease in diameter of the RF electrodes in at least a first portion of the linear ion trap; the RF electrodes being tapered in at least a second portion of the linear ion trap; the RF electrodes being stepped in at least a third portion of the linear ion trap; and the linear ion trap comprising a first set of RF electrodes and at least a second set of electrodes adjacent the exit region, the second set RF electrodes electrically connected to the first set of RF electrodes via a circuit which causes the difference in the RF field. The at least one linear ion trap further comprises at least one electrode between the radial excitation region and the exit for providing a DC (direct current) potential barrier to prevent the unexcited ions from reaching the exit, the pseudo-potential longitudinal axial force on the radially excited ions for overcoming the DC potential barrier such that the radially excited ions overcome the DC potential barrier and exit the at least one ion trap. The mass spectrometer further comprises a detection device for receiving and analyzing at least a portion of the radially excited ions that exit the at least one ion trap.

Mass selective axial ejection (MSAE) is a method of selecting and ejecting ions in a linear ion guide of a mass spectrometer. A range of ions of interest are trapped in a linear ion guide and then mass selectively ejected through an output end of the ion guide. Ions of interest are first excited in the radial direction while a voltage is supplied to a DC barrier electrode located near the output end of the ion guide. The voltage is set to prevent unexcited ions to cross the barrier while allowing excited ions to exit via an aperture. Excited ions can cross the barrier and exit through the aperture due to an additional axial force exerted by fringing fields present at the end of the ion guide. The magnitude of the axial force is dependent on the amplitude of radial excitation.

Efficiency of ejection can be compromised as ions that have high radial amplitude (and high radial energy) can be lost at the aperture due to the relatively large cone angle of the exiting ions. In addition, even if ions make it through the aperture they can still be lost due to an inability of the adjacent ion guide to contain the ions with high radial amplitude or due to extensive fragmentation of ions that acquire high axial energy when exposed to high fringing fields far away from the axis.

FIG. 1 depicts a mass spectrometer 100, mass spectrometer 100 comprising an ion source 120, an ion guide 130, a linear ion trap 140, a collision cell 150 (e.g. a fragmentation module) and a detector 160, mass spectrometer 100 enabled to transmit an ion beam from ion source 120 through to detector 160. In some implementations, mass spectrometer 100 can further comprise a processor 185 for controlling operation of mass spectrometer 100, including but not limited to controlling ion source 120 to ionise the ionisable materials, and controlling transfer of ions between modules of mass spectrometer 100. In operation, ionisable materials are introduced into ion source 120. Ion source 120 generally ionises the ionisable materials to produce ions 190, in the form of an ion beam, which are transferred to ion guide 130 (also identified as Q0, indicative that ion guide 130 takes no part in the mass analysis). Ions 190 are transferred from ion guide 130 to quadrupole 140 (also identified as Q1), which can operate as a mass filter or as a linear ion trap as depicted further in the following figures. Filtered or unfiltered ions then enter collision cell 150 also identified as q2 which can be controlled to eject ions 191 in a desired sequence, as described below. In some implementations, ions 191 can be fragmented in collision cell 150. It is understood that collision cell 150 can comprise any suitable RF ion guide, including but not limited to a multipole such as a quadrupole, a hexapole, or an octopole. Ions 191 are then transferred to detector 160 for production of mass spectra. In doing so, ions 191 enter detector 160 which is enabled to produce mass spectra of ions 191 entering therein. In some implementations, collision cell 150 comprises a quadrupole, mechanically similar to quadrupole 140. In other embodiments collision cell can be replaced by a fragmentation cell where fragmentation of ions is accomplished by any suitable method including but not limited to electron capture dissociation, electron transfer dissociation, photo-dissociation, surface induced dissociation, dissociation due to interaction with metastable particles or the like.

Furthermore, while not depicted, mass spectrometer 100 can comprise any suitable number of vacuum pumps to provide a suitable vacuum in ion source 120, ion guide 130, quadrupole mass filter 140, collision cell 150 and/or detector 160. It is understood that in some implementations a vacuum differential can be created between certain elements of mass spectrometer 100: for example a vacuum differential is generally applied between ion source 120 and ion guide 130, such that ion source 120 is at atmospheric pressure and ion guide 130 is under vacuum. While also not depicted, mass spectrometer 100 can further comprise any suitable number of connectors, power sources, RF (radio-frequency) power sources, DC (direct current) power sources, gas sources (e.g. for ion source 120 and/or collision cell 150), and any other suitable components for enabling operation of mass spectrometer 100.

Figure 2:
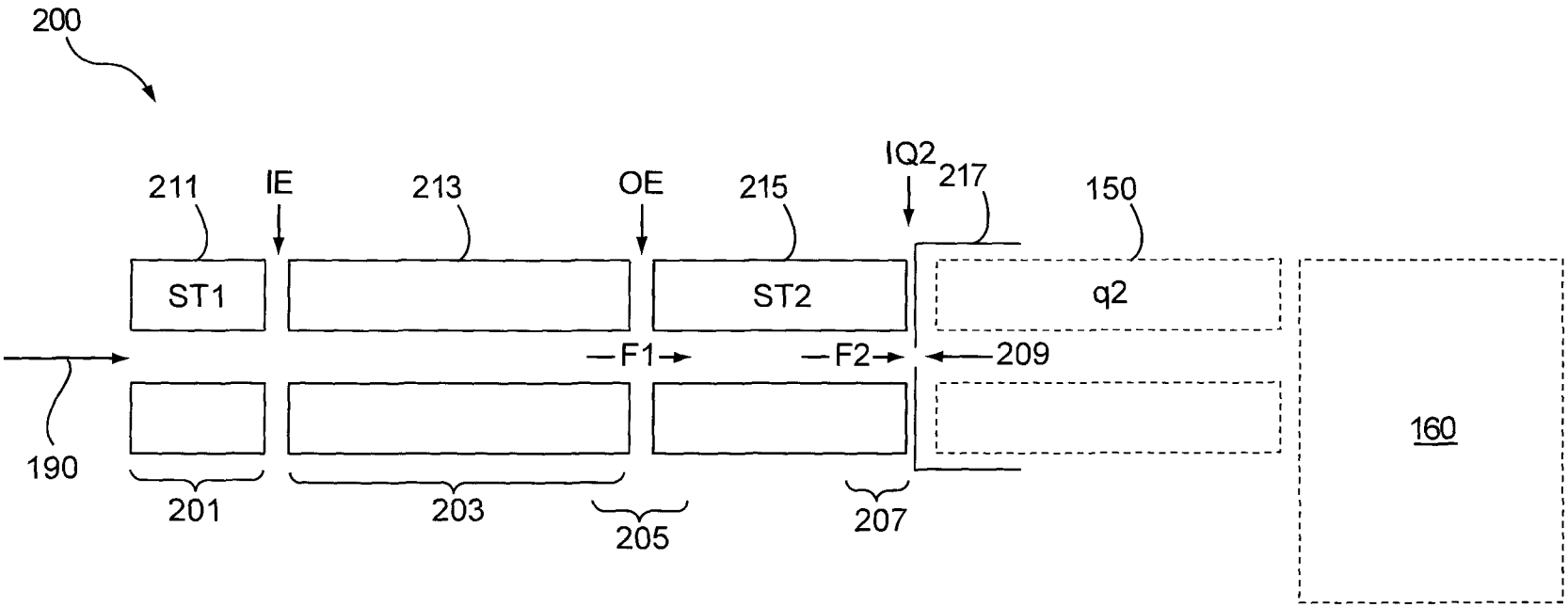
FIG. 2 depicts a block diagram of a linear ion trap for radial amplitude assisted transfer, according to non-limiting implementations.

Attention is now directed to FIG. 2, which depicts a linear ion trap 200 for radial amplitude assisted transfer (RAAT), according to non-limiting implementations, in alignment with collision cell 150 and detector 160. Hence, in depicted implementations linear ion trap 200 comprises linear ion trap 140 of FIG. 1. However, in further implementations, linear ion trap 200 can comprise ion guide 130. In yet further implementations, linear ion trap 200 can comprise collision cell 150.

Linear ion trap 200 comprises an entrance region 201, a radial excitation region 203, a first axial acceleration region 205, a second axial acceleration region 207 and an exit region 209.

Entrance region 201, also labelled ST1 in FIG. 2, comprises a region for receiving ions 190, for example from ion source 120 or any other element of mass spectrometer 100 between ion source 120 and linear ion trap 200. Entrance region 201 generally comprises any suitable linear ion guide 211 for receiving ions into linear ion trap 200, including but not limited to a multipole such as a quadrupole, a hexapole, or an octopole.

Radial excitation region 203, located between entrance region 211 and exit region for 207 is enabled for selective radial excitation of ions trapped in linear ion trap 200 thereby producing radially excited ions via any suitable AC (alternating current) field. Alternatively linear ion trap 200 can be enabled to produce radially excited ions by at least one of: bringing an RF voltage near an instability threshold for selected ions; or by increasing the RF voltage to near an instability threshold for a duration of excitation and then lowering the RF voltage. As such radial excitation region 203 generally comprises any suitable linear ion guide 213 for containing ions therein, including but not limited to a multipole such as a quadrupole, a hexapole, or an octopole, as well as performing selective radial excitation. Selective radial excitation of ions is described in "Mass Selective Axial Ion Ejection from Linear Quadropole Ion Trap" by F. A. Londry and James W. Hager, J. Am. Soc. Mass Spectrom. 2003, 14, 1130-1147, incorporated herein by reference. The entrance of linear ion guide 213 is labelled IE in FIG. 2.

Linear ion trap 200 also comprises a linear ion guide 215 and at least one exit electrode 217, also referred to as exit electrode 217. Linear ion guide 215 is located between linear ion guide 213 and exit electrode 217 and can include but is not limited to a quadrupole, a hexapole, and an octopole. It is appreciated that a radial RF field can be applied at linear ion guide 215 to contain ions therein. The exit of linear ion guide 215 is also labelled OE in FIG. 2.

First axial acceleration region 205 comprises a transition region between linear ion guide 213 and linear ion guide 215 where a first longitudinal accelerating force F1 is applied to ions, provided by a longitudinal DC potential, as will be described below. However, in general, it is appreciated that first axial acceleration region 205 is enabled for axially accelerating at least a portion of ions 190 from ion source 120 along a longitudinal axis of mass spectrometer 100.

Exit region 207 is enabled for applying a DC (direct current) potential barrier to prevent ions 190 from exiting linear ion trap 200. For example, the DC potential barrier can be applied to exit electrode 217. Exit electrode 217 comprises an aperture through which ions which overcome the DC potential barrier applied thereto can pass through.

Second axial acceleration region 207 comprises a region adjacent an exit end of linear ion guide 215 and/or exit region 209. Second axial acceleration region 207 is enabled for further accelerating radially excited ions 190 along the longitudinal axis towards exit region 209 due to a pseudo-potential produced by a reduction in RF field strength adjacent exit region 209, such that said a combination of forces on radially excited ions 190 due to first axial acceleration region 205 and second axial acceleration region 207 causes radially excited ions 190 to overcome the DC potential barrier while ions 190 which are not radially excited remain in linear ion trap 200.

In second axial acceleration region 207, fringing of the RF field applied to linear ion guide 215 causes radially excited ions contained therein to experience a fringing pseudo-potential, as described in "Mass Selective Axial Ion Ejection from Linear Quadropole Ion Trap" by F. A. Londry and James W. Hager, J. Am. Soc. Mass Spectrom. 2003, 14, 1130-1147. The fringing pseudo-potential causes the radially excited ions to experience a longitudinal force F2 towards the exit region 209. It is appreciated that force F2 is further dependent on an amplitude of excitation of radially excited ions 310. It is yet further appreciated that force F2 is "0" on the longitudinal axis but increases with radial distance from the longitudinal axis.

In the prior art, in order to overcome a DC potential barrier applied to at least one exit electrode, F2 is generally increased by increasing the amplitude of excitation of ions. However, this leads to very high exit angles for radially excited ions, which can then be lost either at an aperture of an exit electrode, or between the linear ion trap in which selective radial excitation is occurring and the next module, such as a collision cell: in other words, the exit angle is so high that the exiting ions deviate from a path through the mass spectrometer.

To overcome this problem in linear ion trap 200, it is further appreciated that DC potentials can be independently applied to each of linear ion guides 211, 213, 215, exit electrode 217, and collision cell 150. For example, attention is directed to FIG. 3 which depicts a first profile 300 of DC potentials that can be applied to linear ion guides 211, 213, 215, exit electrode 217, and collision cell 150, each identified by identifiers ST1, IE, OE, ST2. IQ2, and Q2, as in FIG. 2, IE and OE respectively indicative of the entrance and exit to linear ion guide 213. The peak in profile 300 at IQ2 is representative of the DC potential barrier applied to exit electrode 217. It is further appreciated that the DC potential applied to linear ion guides 211, 213, 215 in profile 300 creates a potential well that contains ions 190 in linear ion guide 213 such that ions 190 can be trapped in region 203 as the DC potentials ST1 and ST2 are higher than the DC potential between IE and OE. Once ions 190 are trapped, ions 190 can be selectively radially excited by the application of an auxiliary AC field in resonance with the frequency of radial motion for ions of interest. For example, ions 190 can first be injected into linear ion trap 200 via linear ion guide 211; ions 290 can then be trapped and cooled in linear ion guide 213 via application of profile 300; and then ions 190 trapped in linear ion guide 213 can be selectively radially excited in linear ion guide 213 to produce radially excited ions 310. For example, the injection process can occur over 1 ms, the trapping and cooling process can occur over 100 ms, and the excitation process can occur over 1 ms (at 60 mV of AC voltage applied to the rods of linear ion trap 213 to excite radial motion of ions 190 in resonance). Furthermore, the time for the trapping and cooling process can be reduced by increasing pressure in linear ion trap 213. In some implementations, the pressure of the buffer gas in the trapping region (e.g. between IE and OE) can be increased during the trapping period by utilizing a pulsed valve (not depicted) that opens buffer gas flow during the trapping period. Furthermore, it is appreciated that any suitable subset of ions 190 can be selected for excitation to produce radially excited ions 310 by controlling at least a frequency of the AC field applied to linear ion guide 113. Alternatively the radial oscillation frequency for ions of interest can be adjusted to coincide with the predetermined AC frequency by selecting appropriate amplitude of the RF field used for radial confinement. It is furthermore appreciated that the specificity of selection is generally higher when the excitation process occurs at lower pressure; hence, the pulsed valve can be beneficial for rapid trapping of ions and for reducing the pressure of the buffer gas during the excitation period.

However, once selective radial excitation occurs in linear ion guide 213, a second profile 303 is applied in mass spectrometer 200 to accelerate ions 190 into linear ion guide 215. It is appreciated that profile 303 is substantially similar to profile 300, however the DC potential in linear ion guide 215 is now less than the DC potential between IE and OE (i.e. in linear ion guide 213). Hence, ions 190 trapped in linear ion guide 213 due to profile 300, including radially excited ions 310, are now accelerated towards exit region 207 due to the drop in potential. It is appreciated that the drop in potential causes longitudinal force F1 to be applied to ions 310, including radially excited ions 310. Longitudinal force F1 will hereafter also be interchangeable to as force F1.

However, is it is appreciated that the acceleration of ions 190, including radially excited ions 310, due to force F1 is not sufficient for ions 190 to overcome the DC potential barrier at IQ2/exit region 207. However, as radially excited ions 310 will further experience longitudinal force F2 (referred to hereafter, and interchangeably with, force F2) at exit region 207 due to the fringing pseudo-potential that results from the drop in RF field strength at exit region 207. It is appreciated that force F2 is further dependent on an amplitude of excitation of radially excited ions 310 and that unexcited ions do not experience force F2. Hence, the combination of the acceleration experienced by radially excited ions 310 due to force F1 and the further acceleration experienced by radially excited ions 310 due to force F2 cause the radially excited ions to overcome the DC potential barrier at IQ2 and exit linear ion trap 200. As unexcited ions do not experience force F2, the unexcited ions do not exit linear ion trap 200, despite being exposed to force F1.

Figure 3:
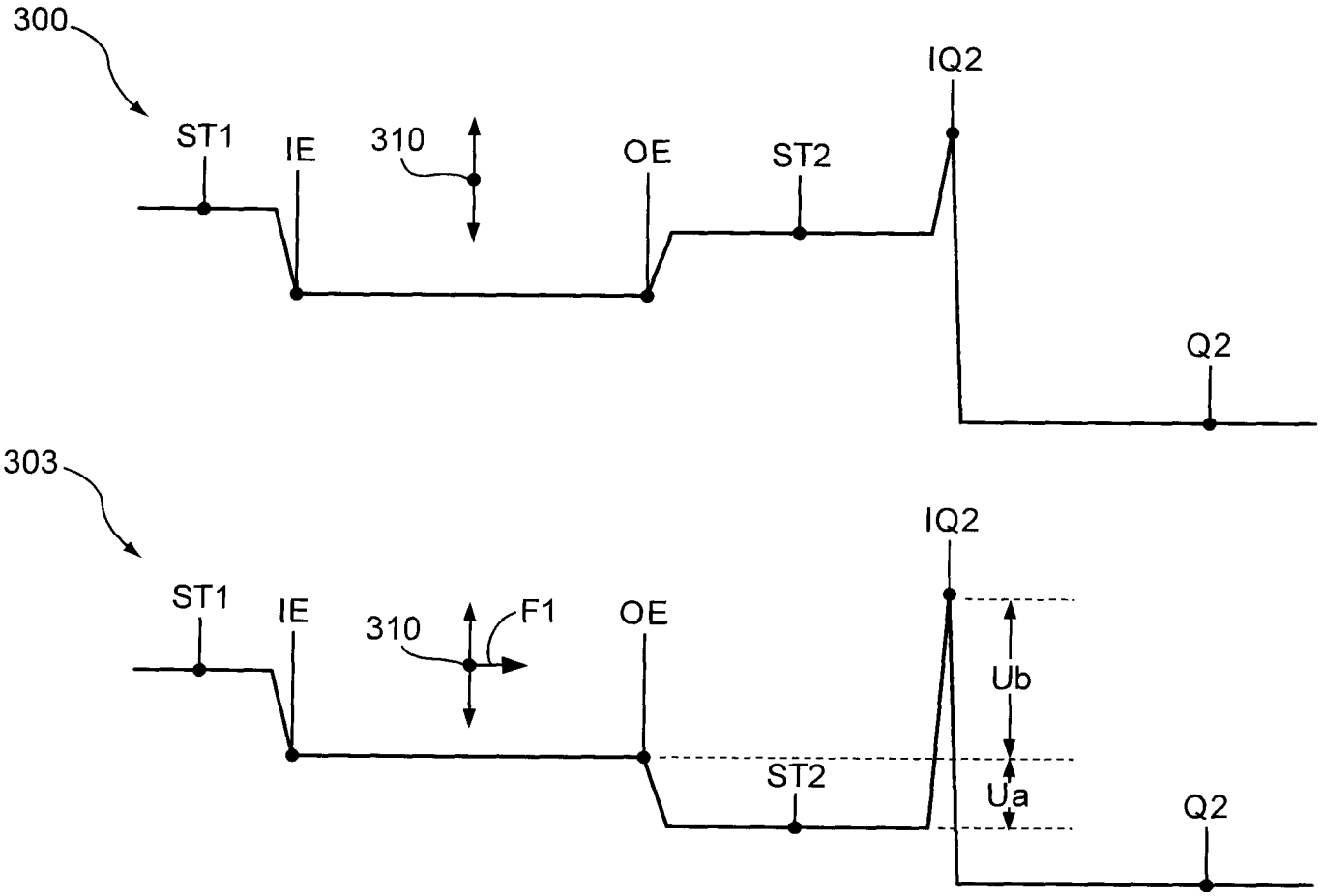
FIG. 3 depicts DC profiles that can be applied in a mass spectrometer including the linear ion trap of FIG. 2, according to non-limiting implementations.

In FIG. 3, Ua is appreciated to be the difference between the DC potential in linear ion guide 215 (i.e. between IE and OE) and the DC potential at ST2. Further Ub is appreciated to be the difference between the DC potential at ST2 and the DC potential barrier at IQ2. Ua can also be referred to as accelerating potential Ua, and Ub can also be referred to as barrier height Ub.

Figure 4:
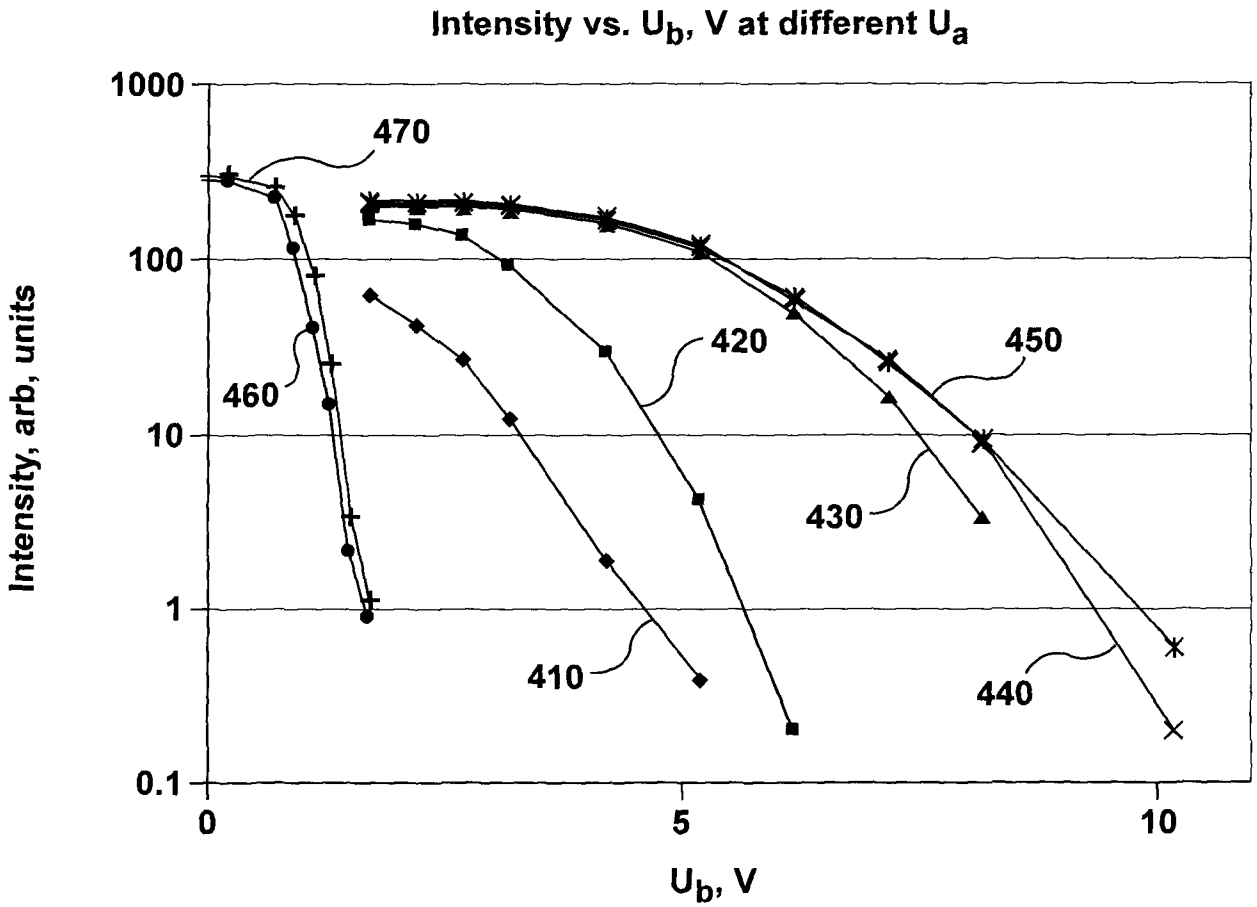
FIG. 4 depicts ion intensity for ion exiting a prototype of the linear ion trap of FIG. 2, according to non-limiting implementations.

Attention is hence directed to FIG. 4, which depicts results of measuring ion intensity of radially excited ions exiting a successful prototype of linear ion trap 200 for accelerating potentials Ua of 0V (curve 410), −0.2V (curve 420), −1V (curve 430), −2V (curve 440), and −4V (curve 450) for barrier heights Ub ranging from 0V to approximately 8.5V. FIG. 4 also depicts results of measuring ion intensity of non excited ions exiting the successful prototype of linear ion trap 200 for accelerating potentials Ua of −0.1V (curve 460), −1 V (curve 470). The ion intensity has been normalized and has arbitrary units. A zero point of Ub (i.e. Ub=0V) corresponds to a potential at which ions without excitation effectively transfer into collision cell 150/Q2 without the separation between ions with high and low radial amplitude. The separation between excited ions (curves 410-450) and non-excited ions (curves 460, 470) occurs at higher barrier voltage. Curve 410 corresponding to excited ions with Ua=0V has the lowest excited ion intensity (corresponding to the lowest transfer efficiency) at any barrier voltage. It is appreciated that higher axial energy assists radially excited ions 310 to transfer across the DC potential barrier at IQ2. Furthermore, not only is efficiency of extraction of radially excited ions 310 improved, as compared to the prior art, but the range of barrier height Ub potentials where efficiency is high is also increased; hence linear ion trap 200 has relaxed voltage tolerances as compared to the prior art.

A simplified theory of RAAT can explain why efficiency of ion extraction increases with higher axial energy (i.e. with axial force F1 applied in addition to force F2 to radially excited ions 310). The theory assumes that ion motion is affected by two forces—one derived from DC potential distribution, i.e. DC barrier force, and another one derived from a net effect of oscillating voltages, i.e. force F2. The force F2 is appreciated to be a pseudo-potential force. Hence, it is appreciated that ion motion in linear ion trap 200 is governed by the combined action of DC potential and pseudo-potential.

An important feature of potential and pseudo-potential distributions is a property that can be referred to as "range". The range is the distance along the longitudinal axis of linear ion trap 200 at which potential distribution is declining to an insignificant value; i.e. range is a measure of how far inside linear ion trap 200 that potential distribution penetrates.

Figure 5A:
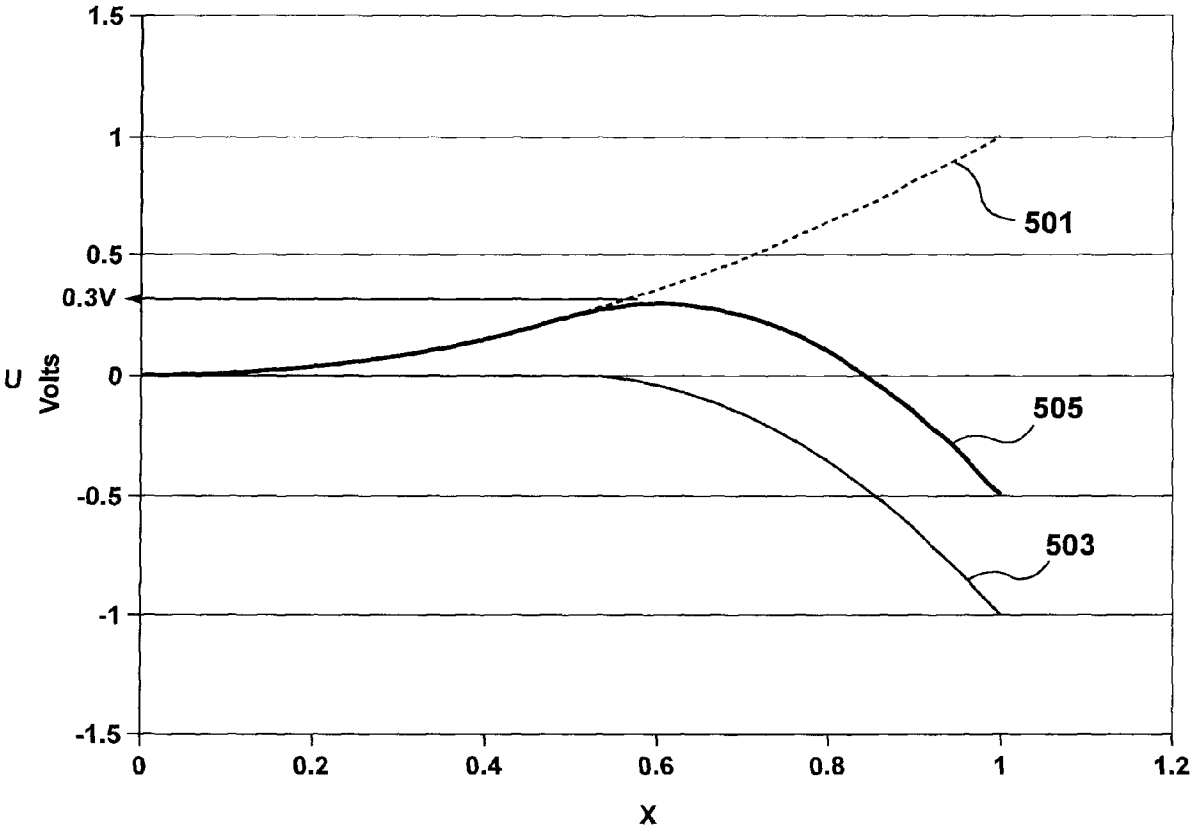
FIG. 5A depicts a graph of a basic model for combining DC potential plus pseudo-potential distribution plotted as a function of coordinate (x) along a length of a linear ion trap according to non-limiting implementations.

In general, it is appreciated that the range of a DC potential, such as the DC barrier potential at IQ2, can be larger than a range of a pseudo-potential, such as the pseudo-potential due to RF field fringing in exit region 207. The effect is depicted in FIG. 5A where combined (potential plus pseudo-potential) distribution, U, is plotted as a function of dimensionless coordinate (x) along the length of linear ion trap 200. x=0 defines a position inside linear ion trap 200 in exit region; specifically, x=0 is chosen to coincide with a position where the DC potential barrier at IQ2 begins to have an effect on ions 190 in linear ion trap 200 near the region with fringing field (i.e. exit region 207). A higher value of x represents a region towards the end of linear ion trap 200 where the effects of fringing field increase. Curve 501 shows DC potential distribution due to the DC potential barrier at IQ2; it is appreciated that curve 501 represents the potential experienced by ions without radial excitation when they are reflected from the fringing field region (i.e. exit region 207). Curve 503 represents the pseudo-potential distribution due to the fringing RF field. Comparing curve 501 to curve 503, it is appreciated that pseudo-potential has a range that is only approximately half of that for DC potential. Curve 505 depicts combined pseudo-potential distribution and DC potential distribution for a given strength. It is appreciated that curves 501, 503, and 505 of FIG. 5 are based on a simplified $x^2$ model of RF pseudo-potential U and DC barrier potential; in linear ion trap 200 x generally represents a dimensionless coordinate along the axis of the linear ion trap 200, with x=0 being the region corresponding to the area where the effect of the IQ2 DC barrier becomes negligible; while x=1 corresponds to the location right at the IQ2 barrier. It is appreciated that x=0.5 defines a halfway point along the x coordinate where the pseudo-potential field acting on excited ions begins to grow in magnitude (e.g. see curve 503).

It is further appreciated that the simplified $x^2$ model is for illustration purposes only and that actual potentials follow more complex laws.

In any event, curve 505 represents the sum of the pseudo-potential and DC potential experienced by radially excited ions 310 in linear ion trap 200 in exit region 207 for a given magnitudes of radial excitation. It is appreciated from curve 505 that under these conditions radially excited ions 310 need at least 0.3 V of axial energy to get transferred through such potential distributions, according to this model. However, it is appreciated that 0.3 V is merely an approximation and is not to be considered unduly limiting. In any event, the additional 0.3 V of initial ion energy can be obtained from force F1 from the first axial acceleration region 205. In the absence of that energy the radially excited ions 310 cannot exit the DC barrier at IQ2 even though radially excited ions 310 have acquired a sufficient amount of radial excitation. In the illustrative $x^2$ model described above radially excited ions 310 without initial axial energy of at least 0.3 V would not be able to cross the barrier no matter how high their radial excitation (and the magnitude of F2) is. In the successful prototype of linear ion trap 200, however, the ranges of the potentials at which radially excited ions 310 exit linear ion trap 200 are a bit blurry and at high enough excitation radially excited ions 310 can still cross the barrier at IQ2 though the efficiency of the process is compromised as illustrated by curve 410 of FIG. 4.

Implementations where curves 501, 503 and 505 are applicable are represented by FIG. 2, and FIGS. 6, 9, 11, and 13, described below.

However, any suitable arrangement and implementation of DC potentials or changes in RF field strength for exposing radially excited ions to at least one additional longitudinal force, in addition to force F2 due to the fringing pseudo-potential, are within the scope of the present specification.

Figure 5B:
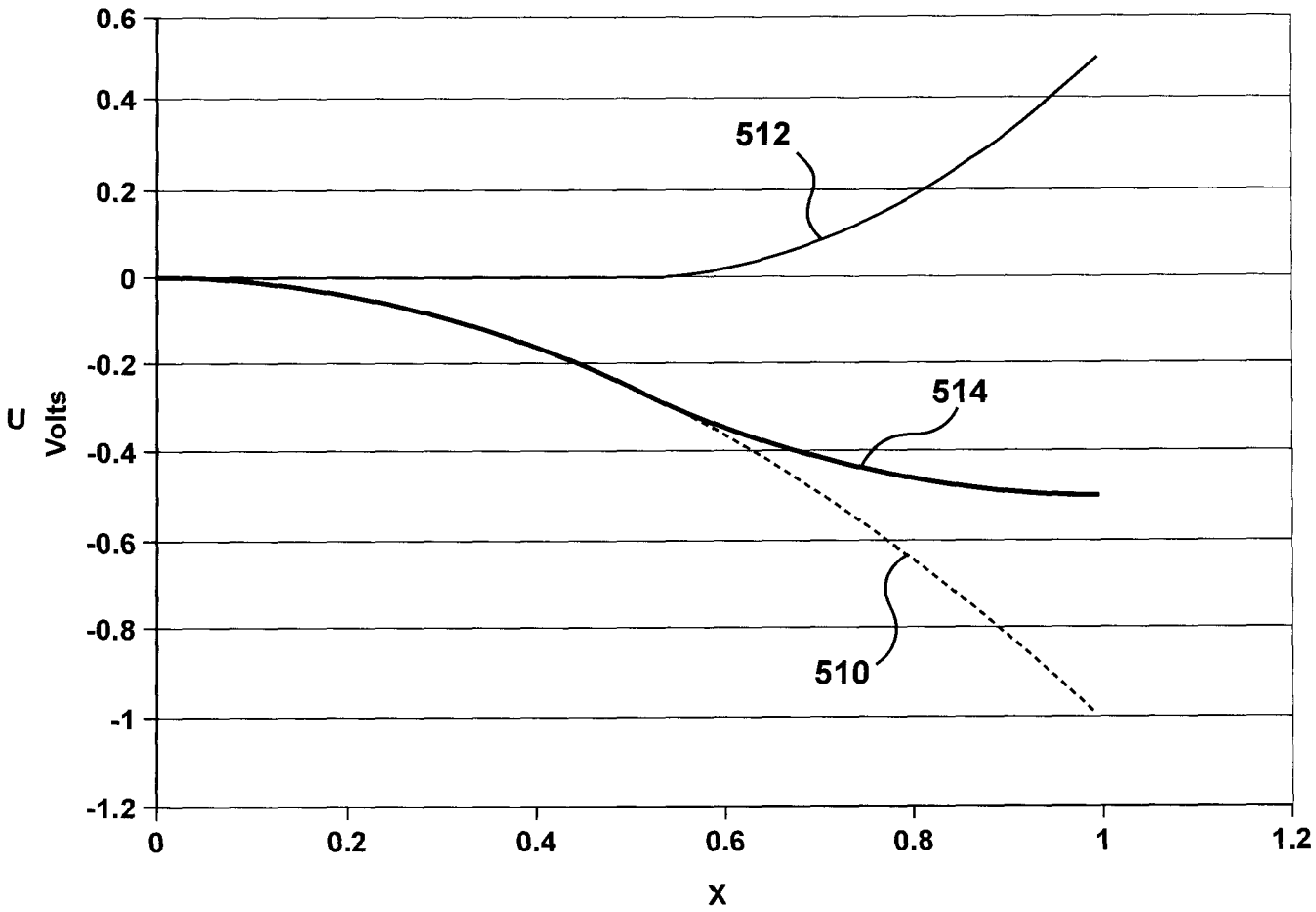
FIG. 5B depicts a graph of a basic model for combining DC potential plus pseudo-potential distribution plotted as a function of coordinate (x) along a length of a linear ion trap according to non-limiting implementations.

Attention is now directed to FIG. 5B, where combined (potential plus pseudo-potential) distribution U is plotted as a function of dimensionless coordinate (x) along the length of linear ion trap 200, similar to FIG. 5A. However, FIG. 5B depicts potential distributions of implementations where the range of the pseudo-potential (curve 510) is larger than the range of the DC barrier potential (curve 512), with curve 514 representing the sum of curves 510 and 512. In this arrangement no initial energy is required for excited ions to be selectively transferred from linear ion trap 200, and non-excited ions are still repelled by the DC barrier. In these implantations, additional force F1 is beneficial because it speeds up the transfer process, which is important in practical applications. Another benefit of force F1 is in overcoming of longitudinal DC potential imperfection due to surface charging in various spots on the rods. Such implementations are represented by FIGS. 16, 17, 18, 21 and 23, described below.

Figure 6:
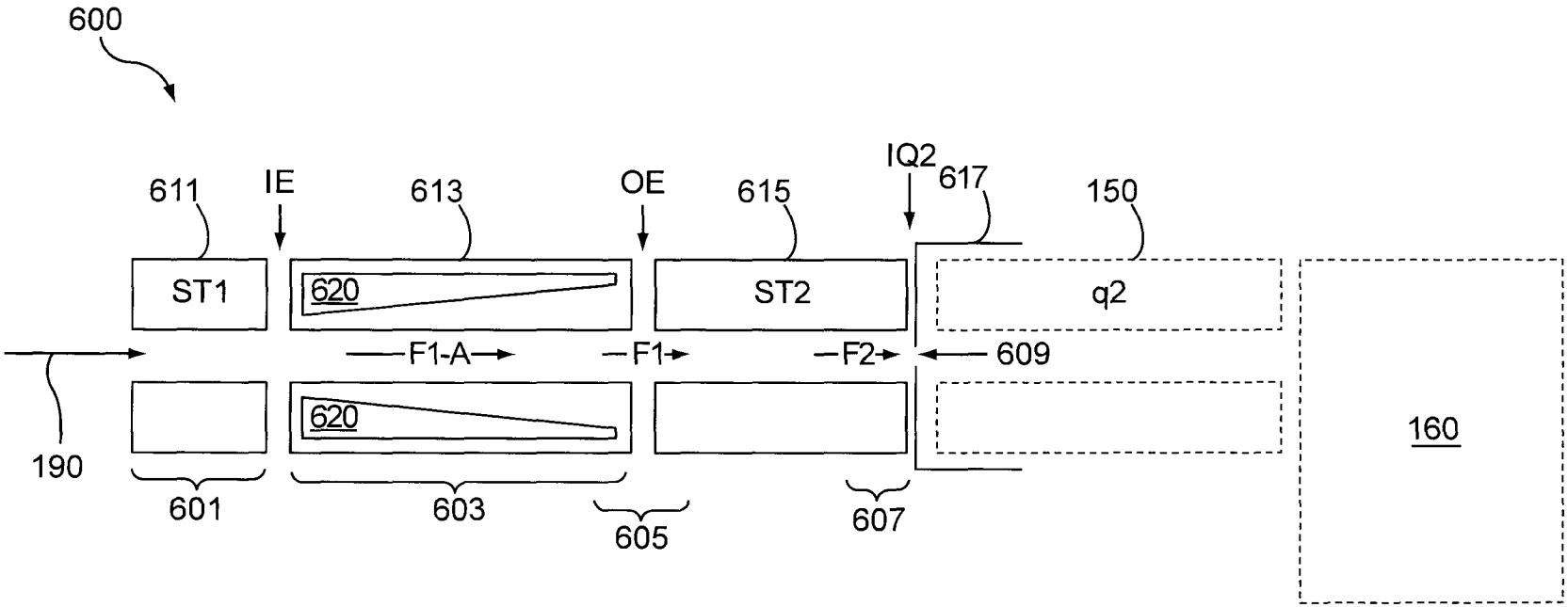
FIG. 6 depicts a block diagram of a linear ion trap for radial amplitude assisted transfer, according to non-limiting implementations.

Attention is now directed to FIG. 6, which depicts a linear ion trap 600, similar to linear ion trap 200 with like elements having like numbers preceded by "6" rather than "2". For example, entrance region 601 is similar to exit region 201. Furthermore, ion beam 190, collision cell 150 and detector 160 are also depicted as in FIG. 6. However, in these implementations, linear ion guide 613 includes at least one set of opposing DC electrodes 620 for providing a longitudinal DC potential. DC electrodes 620 are tapered such that a distance there between increases from near the entrance to linear ion guide 613 to near the exit of linear ion guide 613. Hence, by applying a DC potential difference between DC electrodes (and a main rod set of linear ion trap 613), a decreasing DC profile can be applied to ions 190 stored in linear ion guide 613, resulting in a longitudinal DC potential and hence an axial force F1-A being applied to ions 190 stored in linear ion guide.

Alternatively, a similar force to force F1-A can be applied to ions 190 by removing DC electrodes 620 and replacing the main rod set of linear ion guide 613 with a rod set to which resistive coatings have been applied, and subsequently applying a DC potential towards an entrance end of linear ion guide 613, in addition to any RF and/or AC potential. Hence, ions 190 will experience a decreasing DC potential along the longitudinal axis from entrance end of linear ion guide 613 to an exit end of linear ion guide 613 and hence a longitudinal accelerating force.

Figure 7:
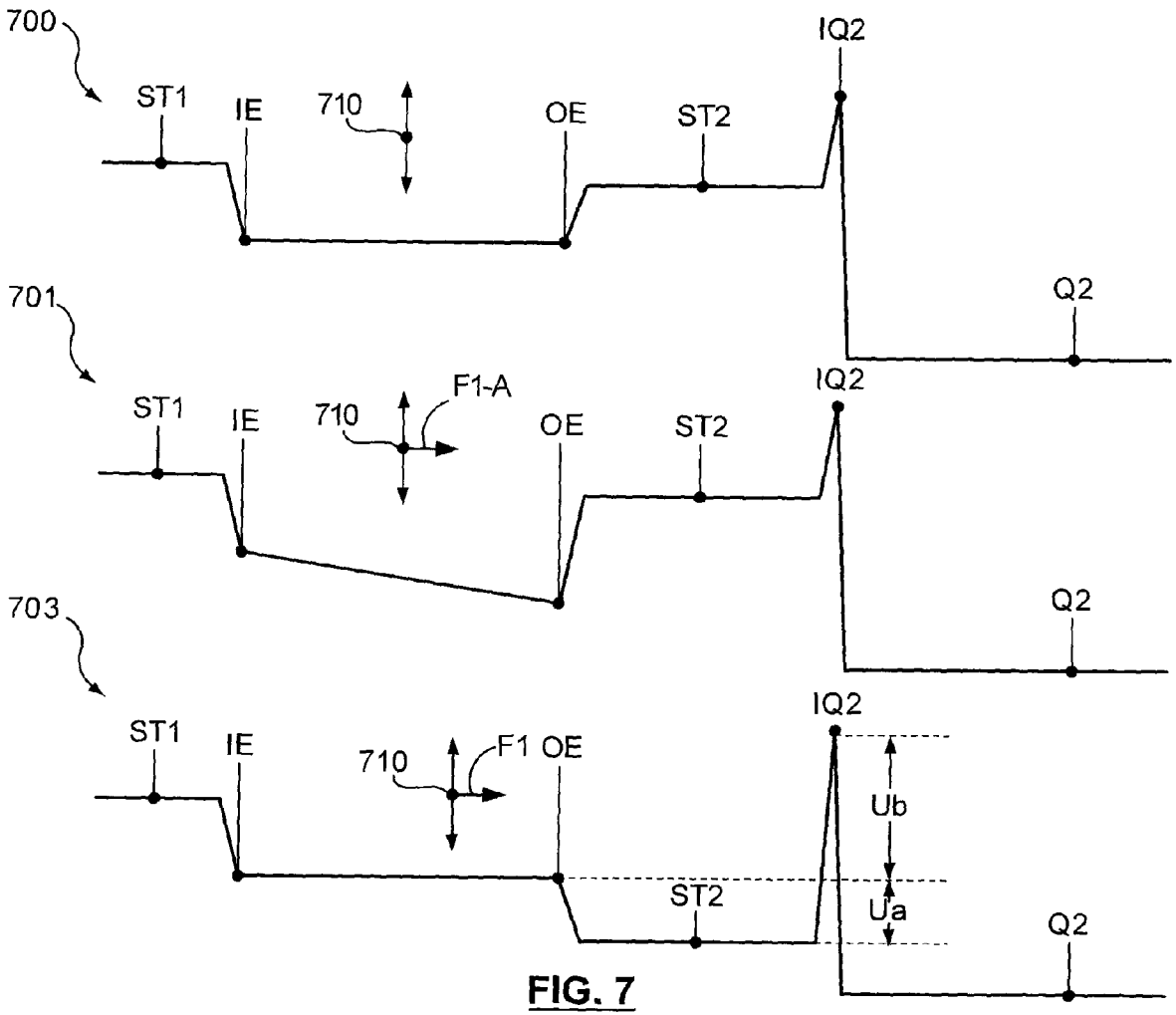
FIG. 7 depicts DC profiles that can be applied in a mass spectrometer including the linear ion trap of FIG. 6, according to non-limiting implementations.

Furthermore, attention is directed to FIG. 7, which depicts DC profiles 700, 701, 703 that can be applied in a mass spectrometer comprising linear ion trap 600. DC profile 700 and 703 are similar to DC profiles 300 and 303, respectively, of FIG. 3. Hence, ions 190 can be trapped between IE and OE in linear ion guide 613 and a selective AC excitation field can be applied to produce radially excited ions 710, similar to radially excited ions 310. DC profile 701 can then be applied in which a DC potential is applied to DC electrodes 620 producing a decreasing DC field between IE and OE, hence applying force F1-A to ions 190 trapped in linear ion guide 613, including radially excited ions 710. DC profile 703 can then be applied, similar to DC profile 303 in FIG. 3, to apply force F1 to ions, including radially excited ions 710. The combination of force F1-A due to the ramped DC field, force F1 due to the potential difference between linear ion guide 613 and linear ion guide 615, and force F2 due to the fringing pseudo-potential in exit region 606 enables radially excited ions 710 to overcome the DC potential barrier at IQ2 and exit linear ion trap 600. As unexcited ions do not experience force F2, unexcited ions do not exit linear ion trap 600. Furthermore, as radially excited ions 710 are accelerated due to a combination of forces F1-A, F1 and F2, the amplitude of excitation can be smaller than with ions in linear ion traps that rely solely on pseudo-potential forces to overcome a DC potential barrier in an exit region.

Figure 8:
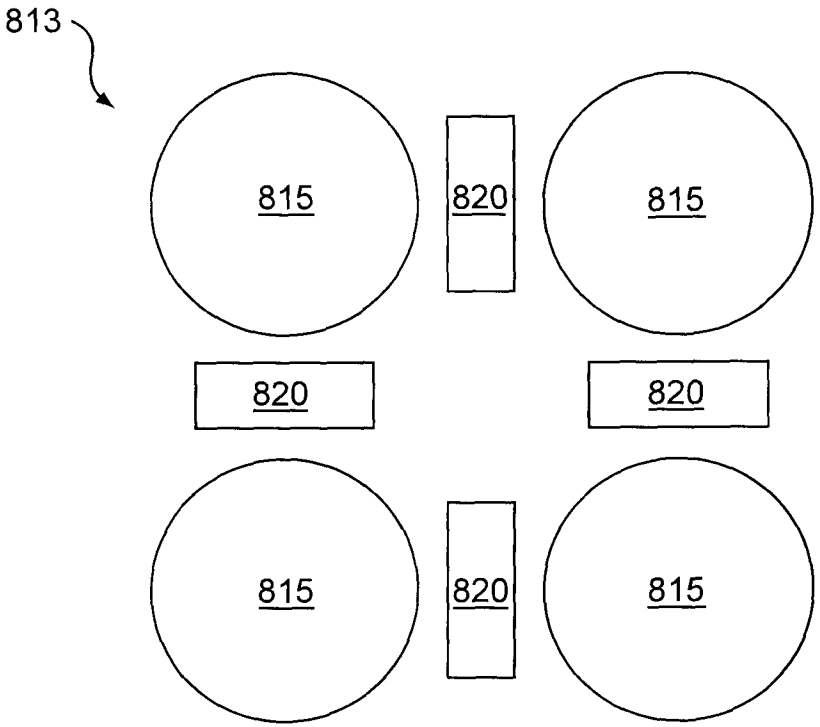
FIG. 8 depicts a cross-section of the linear ion trap of FIG. 6, according to non-limiting implementations.

In implementations, where linear ion guide 613 comprises a multipole, linear ion guide 613 can further comprise a pair of opposing DC electrodes 620 for each pair of rods in linear ion guide 613. For example, FIG. 8 depicts a cross-section of a linear ion guide 813 similar to linear ion guide 613, wherein linear ion guide 613 comprises a quadrupole hence having two pairs of rods 815 (four rods 815 in total). Linear ion guide 813 further comprises two pairs of opposing DC electrodes 820, each similar to DC electrodes 620 as each electrode 820 is tapered longitudinally as depicted in FIG. 7. Hence, ions trapped in linear ion guide 813 can be selectively radially excited by applying a suitable AC field or fields to opposing rods 815, and a ramped DC potential, that decreases from the entrance to the exit of linear ion guide 813, can be created by applying DC voltage to opposing DC electrodes 820 to apply force F1-A to ions trapped therein, including radially excited ions; the DC voltage applied to electrodes 820 being different from the DC voltage applied to electrodes 815.

Figure 9:
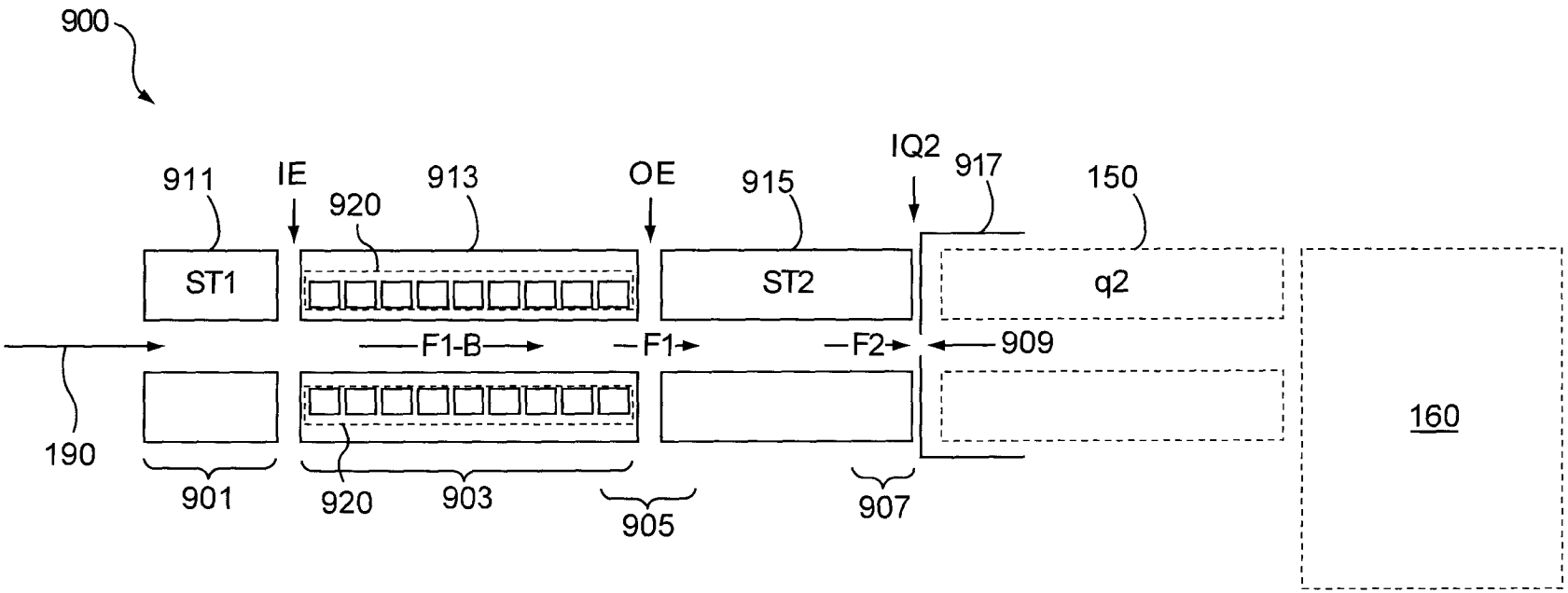
FIG. 9 depicts a block diagram of a linear ion trap for radial amplitude assisted transfer, according to non-limiting implementations.
Figure 21:
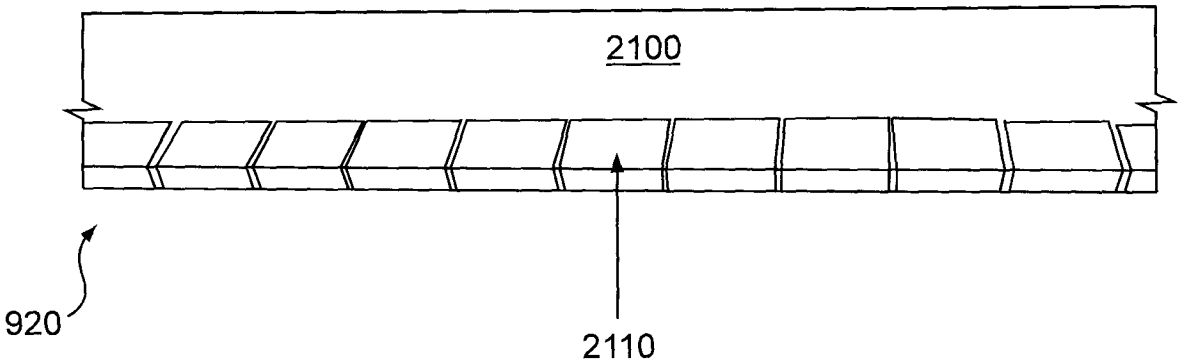
FIG. 21 depicts a perspective view of a PCB (printed circuit board) used as a series of DC electrodes, according to non-limiting implementations.

Attention is now directed to FIG. 9, which depicts a linear ion trap 900, similar to linear ion trap 600 with like elements having like numbers preceded by "9" rather than "6". For example, entrance region 901 is similar to exit region 601. Furthermore, ion beam 190, collision cell 150 and detector 160 are also depicted as in FIG. 9. However, in these implementations, linear ion guide 913 includes at least two opposing series of DC electrodes 920 to which different DC potentials can be applied, for example as in DC profile 1001 depicted in FIG. 10. Hence, the DC potential between DC electrodes 920 can be stepped to provide a decrease in DC potential between IE and OE in linear ion guide 913, resulting in an overall longitudinal DC potential and hence an axial force F1-B being applied to ions 190 stored in linear ion guide 913. The cross section of linear ion guide 913 can be similar to the cross section of linear ion guide 813 of FIG. 8. In some non-limiting implementations, as depicted in FIG. 21, each DC electrode 920 can comprise a printed circuit board (PCB) 2100, wherein each PCB 2100 has electrodes 2110 (only one electrode 2101 indicated for clarity) on an edge (e.g. electrodes 2110 are deposited on edges of a respective PCB 2100) and the edge of each PCB 2110 resides between each rod of linear ion trap 913. It is appreciated that electrodes 2110 extend all the way to the edge of PCB 2100 that is towards the longitudinal axis of linear ion trap 913. It is further appreciated that electrodes 2110 on PCB 2100 have three sides: two sides along a flat side of each PCB 2100 and one on the edge of PCB 2100. Furthermore, each series of opposed DC electrodes 920 are independently controlled (e.g. on a respective PCB 2100) to apply a longitudinal DC potential to ions 190 as DC potential steps in each successive electrode 920 in the series as will now be described.

Figure 23:
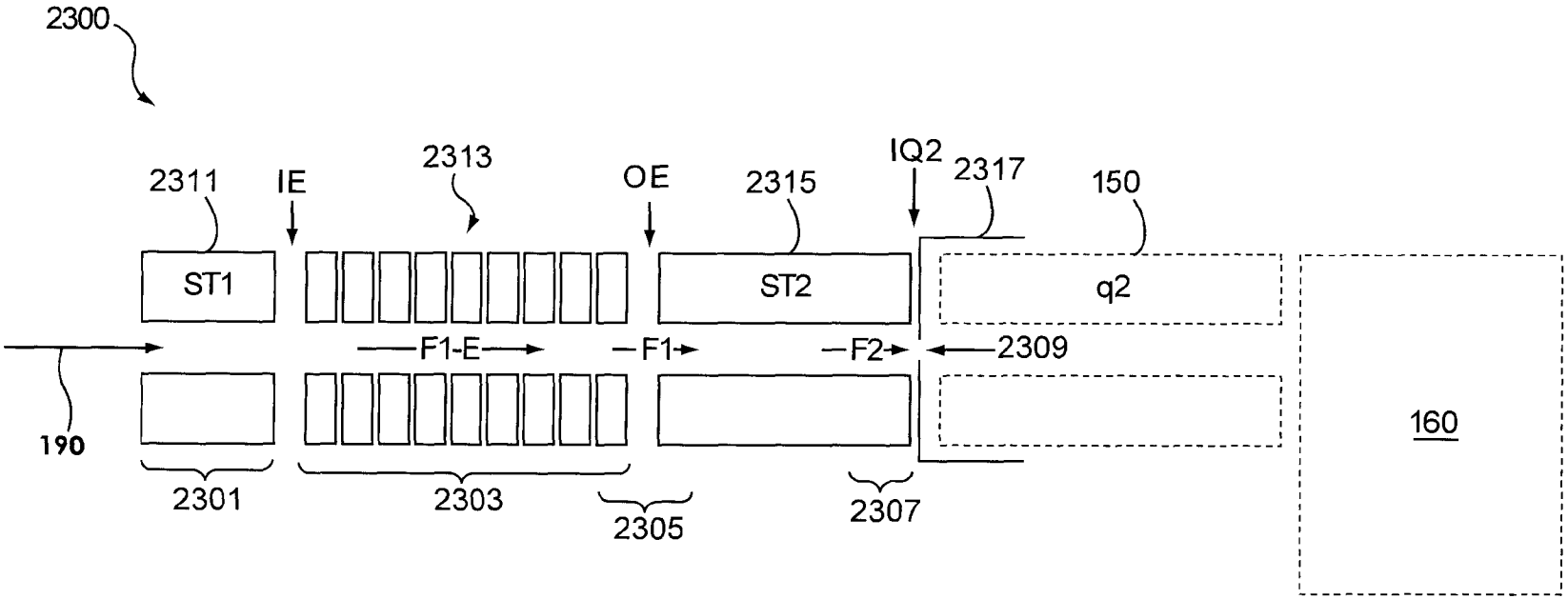

Attention is now directed to FIG. 23, which depicts a linear ion trap 2300, similar to linear ion trap 900 with like elements having like numbers preceded by "23" rather than "9". For example, entrance region 2301 is similar to entrance region 901. However, in FIG. 23, a similar effect to DC electrodes 920 is achieved by segmenting the main rodset of linear ion guide 2313 and applying different DC voltages to different segments in order to apply force F1-E, similar to force F1-B. In these implementations DC electrodes 920 can be removed. Alternatively, the segmented RF electrodes of linear ion guide 2313 are each driven at respective RF voltages which decrease from an entrance end of radial acceleration region 2303 to an exit end of radial acceleration region 2303. For example, each segment can be connected via a circuit similar to circuit C1 of FIG. 17, described below and/or each segment can be independently driven.

Figure 10:
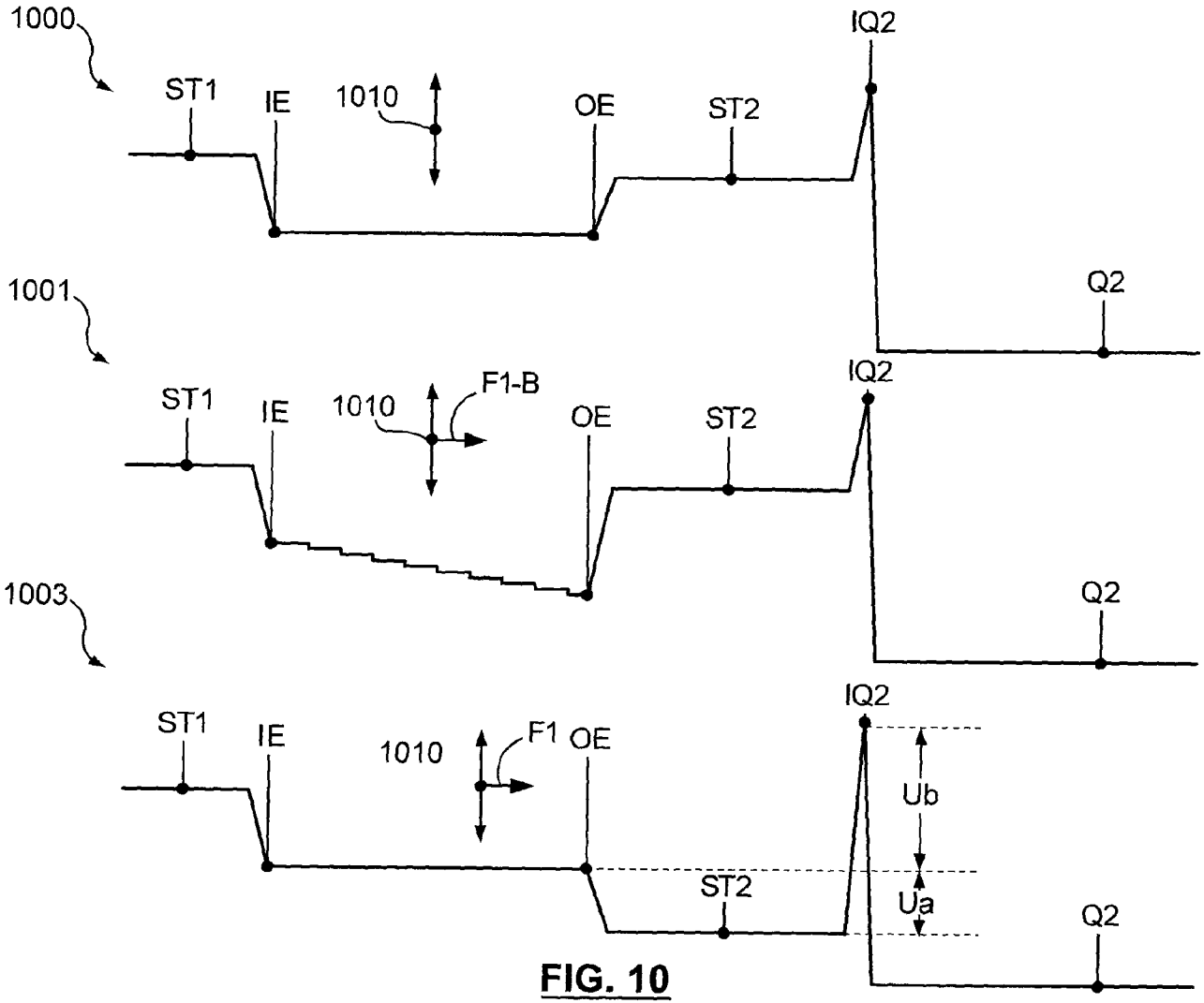
FIG. 10 depicts DC profiles that can be applied in a mass spectrometer including the linear ion trap of FIG. 9, according to non-limiting implementations.

Attention is now directed to FIG. 10, which depicts DC profiles 1000, 1001, 1003 that can be applied in a mass spectrometer comprising linear ion trap 900. DC profile 1000 and 1003 are similar to DC profiles 700 and 703, respectively, of FIG. 7. Hence, ions 190 can be trapped between IE and OE in linear ion guide 913 and a selective AC excitation field can be applied to produce radially excited ions 1010, similar to radially excited ions 610. DC profile 1001 can then be applied in which a series of DC potential differences are applied to DC electrodes 920 producing a stepped decreasing DC field between IE and OE, hence a longitudinal DC potential to ions resulting in applying force F1-B to ions 190 trapped in linear ion guide 913, including radially excited ions 1010. DC profile 1003 can then be applied, as in FIG. 3, to apply force F1 to ions, including radially excited ions 1010. The combination of force F1-B due to the ramped DC field, force F1 due to the potential difference between linear ion guide 913 and linear ion guide 915, and force F2 due to the fringing pseudo-potential in exit region 907 enables radially excited ions 1010 to overcome the DC potential barrier at IQ2 and exit linear ion trap 900. As unexcited ions do not experience force F2, unexcited ions do not exit linear ion trap 900. Furthermore, as radially excited ions 1010 are accelerated due to a combination of forces F1-B, F1 and F2, the amplitude of excitation can be smaller than with ions in linear ion traps that rely solely on pseudo-potential forces to overcome a DC potential barrier in an exit region.

Figure 11:
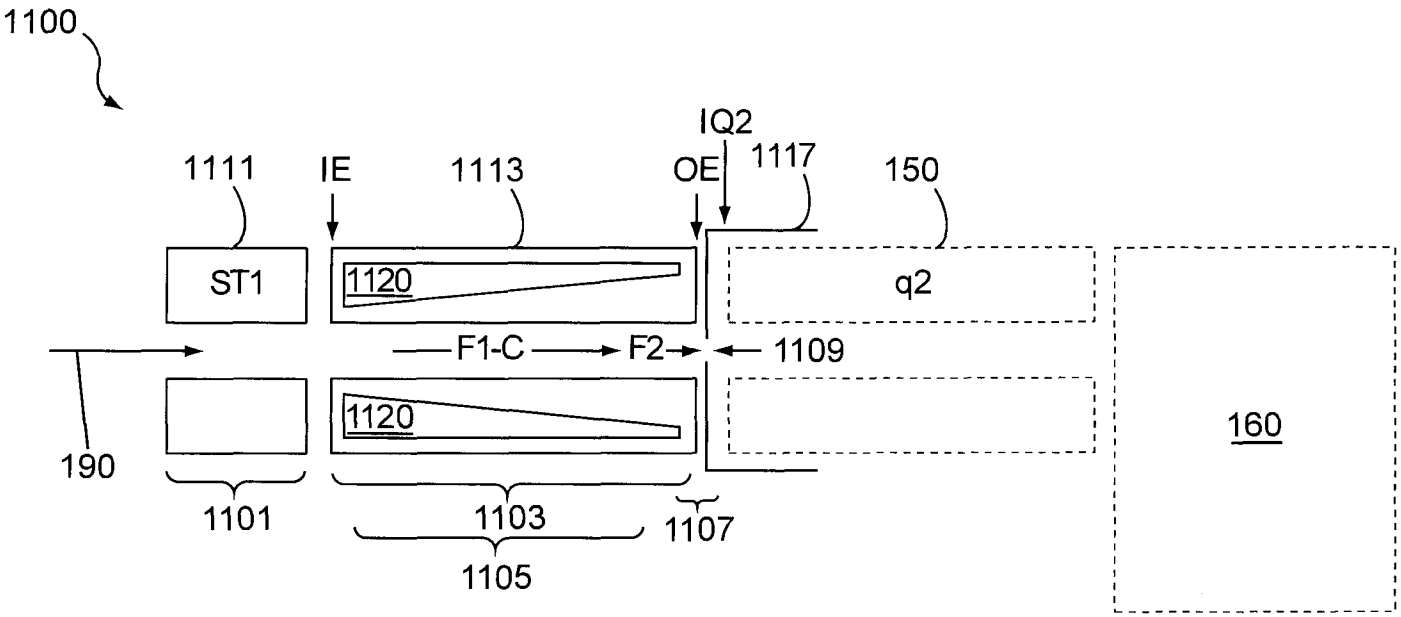
FIG. 11 depicts a block diagram of a linear ion trap for radial amplitude assisted transfer, according to non-limiting implementations.

Attention is now directed to FIG. 11, which depicts a linear ion trap 1100, similar to linear ion trap 600 with like elements having like numbers preceded by "11" rather than "6". For example, entrance region 1101 is similar to exit region 601. Furthermore, ion beam 190, collision cell 150 and detector 160 are also depicted as in FIG. 9. However, in these implementations, an exit of linear ion guide 1113, which includes at least one set of opposing DC electrodes 1120 to which a DC potential can be applied, is adjacent to at least one exit electrode 1117. In other words, an equivalent to linear ion guide 615 is not present in linear ion trap 1100. Rather, the DC potential applied to DC electrodes 1120 results in on axis longitudinal DC potential and hence an axial force F1-C being applied to ions 190 stored in linear ion guide 1113, as depicted in DC profile 1201 of FIG. 12.

Figure 12:
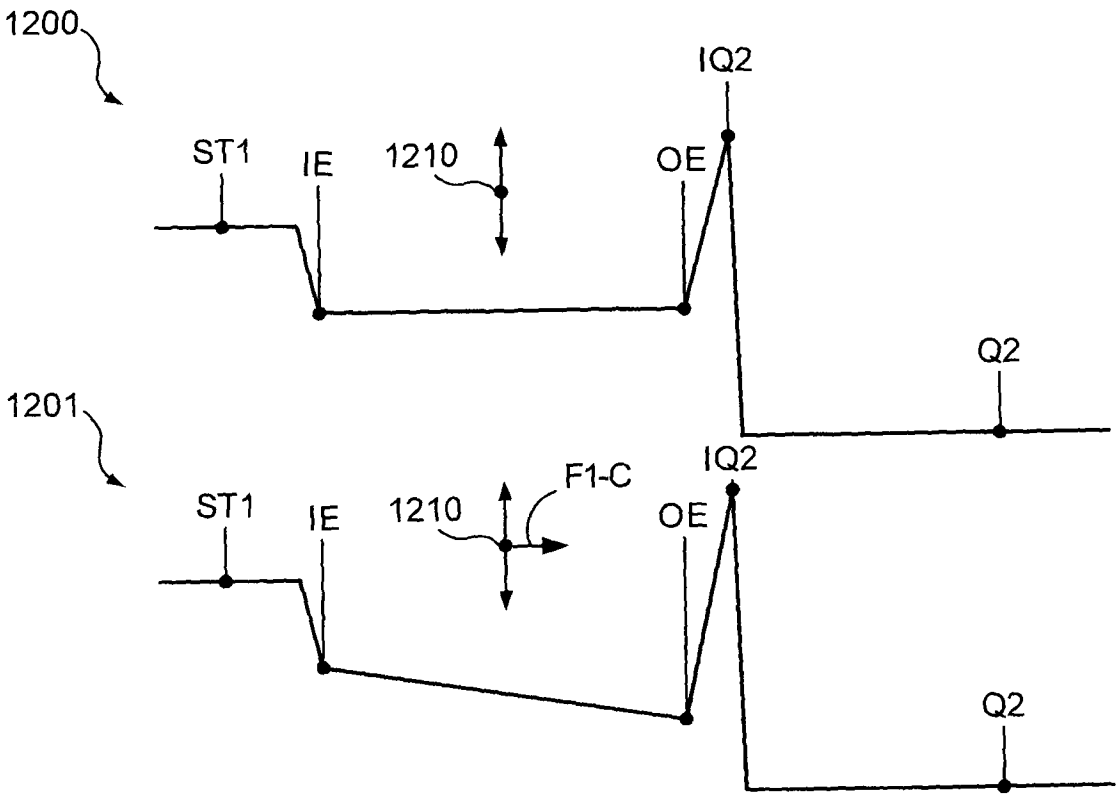
FIG. 12 depicts DC profiles that can be applied in a mass spectrometer including the linear ion trap of FIG. 11, according to non-limiting implementations.

Hence, with reference to FIG. 12, DC profiles 1200, 1201 can be applied to a mass spectrometer comprising linear ion trap 1100. DC profiles 1200 and 1201 are similar to DC profiles 700 and 701, respectively, of FIG. 7, however ST2 is absent from DC profiles 1200, 1201. Rather, radially excited ions 1210 are contained in linear ion guide 1113 by DC potentials applied at ST1 and DC barrier potential IQ2. Axial force F1-C is then applied between IE and OE by applying a DC potential to electrodes 1120, which results in axial force F1-C accelerating ions trapped between IE and OE, including radially excited ions 1210, to be accelerated towards the DC potential barrier at IQ2. The combination of axial force F1-C due to the ramped DC field, and force F2 due to the fringing pseudo-potential in exit region 1107 enables radially excited ions 1210 to overcome the DC potential barrier at IQ2 and exit linear ion trap 1100. As unexcited ions do not experience force F2, unexcited ions do not exit linear ion trap 1100. Furthermore, as radially excited ions 1110 are accelerated due to a combination of forces F1-C and F2, the amplitude of excitation can be smaller than with ions in linear ion traps that rely solely on pseudo-potential forces to overcome a DC potential barrier in an exit region. Hence, while axial force F1 as depicted in FIGS. 6 and 7 is not present in linear ion guide 1100, a magnitude of force F1-C is adjusted to compensate for the lack of axial force F1 to overcome the DC potential barrier at IQ2.

In some implementations, DC profile 1200 is first applied to linear ion trap 1100 to trap ions 190 in linear ion guide 1113. Then, DC profile 1201 is applied to linear ion trap 1100 to apply force F1-C to ions 190. However, force F1-C is applied only for a given period of time such that radially excited ions 1210 gain enough energy and/or acceleration to overcome the DC barrier at IQ2 (e.g. 0.3 V as in FIG. 5A). Indeed, it is appreciated that as ions 190 and/or radially excited ions 1210, are spatially distributed along linear ion guide 1113, unexcited ions 190 that are closer to the exit region of linear ion guide 1113 will be reflected from the DC potential barrier at IQ2 once force F1-C is applied, and will be trapped in a region adjacent to the exit region of linear ion guide 1113 potentially leading to a build-up of space charge, which can affect the DC and/or RF fields being applied. Furthermore, ions 190, including unexcited ions 190, closer to IE (i.e. the entrance of linear ion guide 1113) will experience force F1-C for a longer period of time and gain more energy before encountering the DC potential at IQ2. This would result in a wide spread in axial energies for the ions of interest, which in turn will compromise the quality of separation between excited and non-excited ions. Note, the negative effect of wide spread in axial energies can be visualized by imagining a blurring along the $U_b$ axis of the curves 460 and 440 shown in FIG. 4. When the blurred curve for non-excited ions (460) will start to overlap with the blurred curve for excited ions (curve 440) separation between excited and non-excited ions will be compromised.

Hence, to overcome this issue in some implementations, DC profile 1201 is applied for a time period that is 10 to 100 times shorter than the time for ions 190 to travel from IE to OE. Hence, the magnitude of F1-C can be chosen accordingly and force F1-C can be applied long enough so that radially excited ions 1210 gain sufficient amount of energy in the axial direction to overcome the DC potential barrier at IQ2, but short enough such that only a small fraction of ions 190 will experience reflection at IQ2 during the application of F1-C. It is appreciated that ions reflected at IQ2 during application of F1-C will not gain the same amount of axial energy as the rest of the ions (i.e. ions not reflected from IQ2). Therefore, in some instances, a small fraction of ions reflected at IQ2 might not be transferred using the RAAT technique even though they will have radial excitation. That small fraction of ions will be lost for analysis. However, the loss of a small fraction (for example 10% of the ions) is acceptable for the majority of applications. Hence, a cycle for trapping, exciting and transferring radially excited ions 1210 can comprise: trap ions 190 using DC profile 1200; excite selected group of ions 190 to produce radially excited ions 1210; apply DC profile 1201 for a short duration to give ions a "kick" using force F1-C; re-apply DC profile 1200 and transfer radially excited ions 1210. It is appreciated that similar principles can be applied to application of DC profiles 701, 1001 to avoid creating wide spread in axial energies for ions of the same kind in linear ion traps 600, 900, 1300, 2300, 2400 as well as any other implementations where a similar problem arises.

Figure 13:
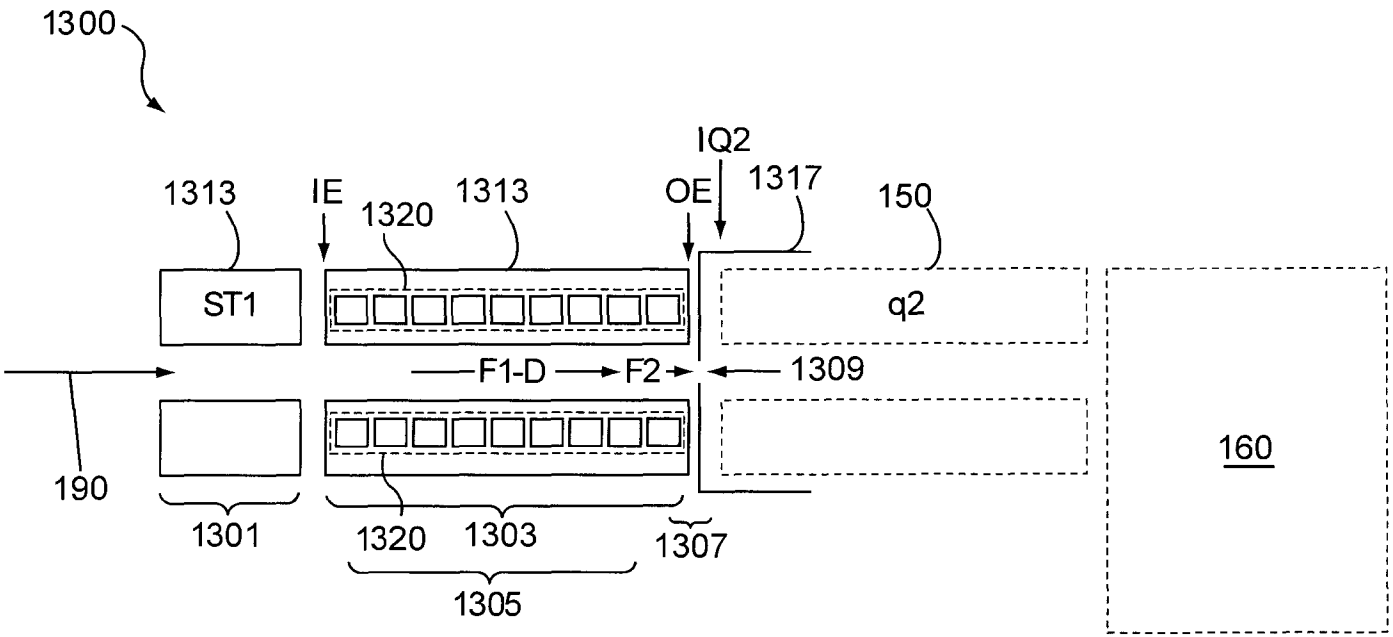
FIG. 13 depicts a block diagram of a linear ion trap for radial amplitude assisted transfer, according to non-limiting implementations.
Figure 14:
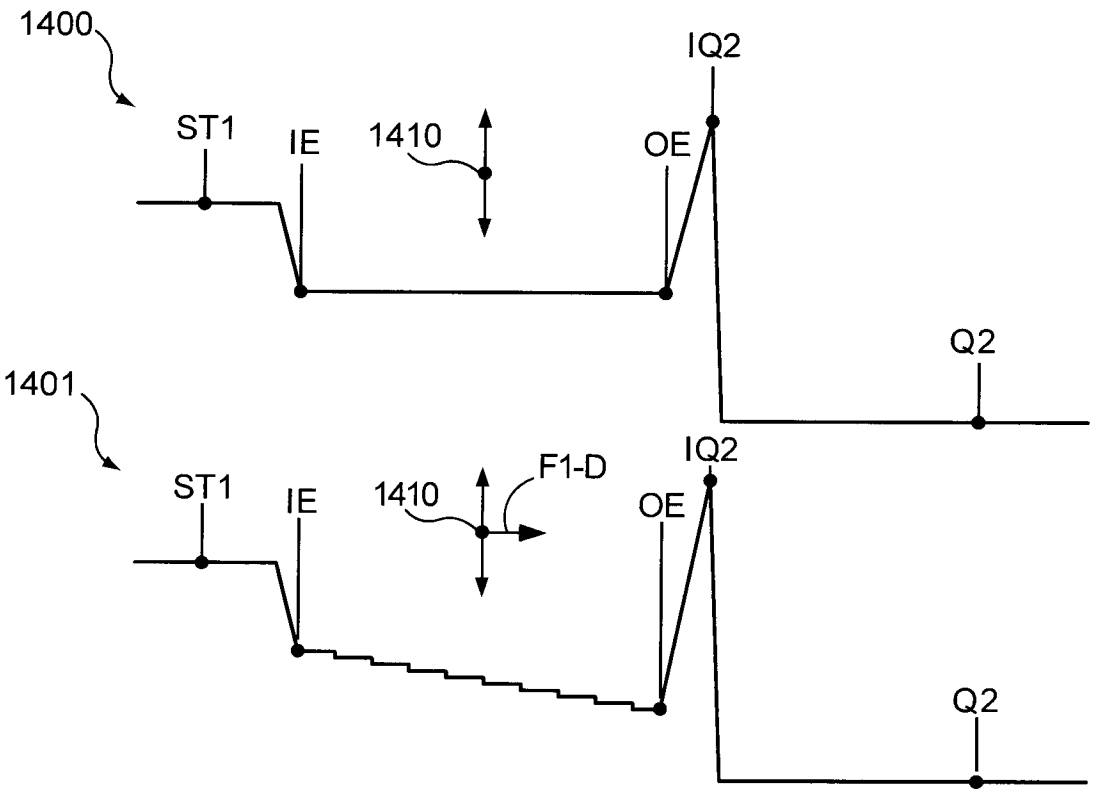
FIG. 14 depicts DC profiles that can be applied in a mass spectrometer including the linear ion trap of FIG. 13, according to non-limiting implementations.

Attention is now directed to FIG. 13, which depicts a linear ion trap 1300, similar to linear ion trap 1100 with like elements having like numbers preceded by "13" rather than "11". For example, entrance region 1301 is similar to exit region 1101. However, in linear ion trap 1300, DC electrodes 1220 have been replaced by DC electrodes 1320 similar to DC electrodes 920 of FIG. 9. Hence, a stepped decreasing potential can be applied between DC electrodes 1320, as in DC profile 1401 of FIG. 14, resulting in a longitudinal DC potential. DC profiles 1400 and 1401 are similar to DC profiles 1200 and 1201 of FIG. 12, and can be applied in a similar manner to a mass spectrometer comprising linear ion trap 1100, however DC profile 1401 comprises a stepped decreasing DC potential between IE and OE which is applied to ions trapped there between including radially excited ions 1410 resulting in a longitudinal DC potential and hence an axial force F1-D on radially excited ions 1410 that assists in overcoming the DC barrier potential at IQ2 in combination with axial force F2, as described above. In addition, principles to those associated with DC profile 1201 can be used to determine a length of time for applying DC profile 1401.

Alternatively, a similar effect to DC electrodes 1320 can be achieved by segmenting the main rodset of linear ion guide 1313 and applying different DC voltages to different segments, similar to FIG. 23. In these implementations DC electrodes 1320 can be removed.

Figure 15:
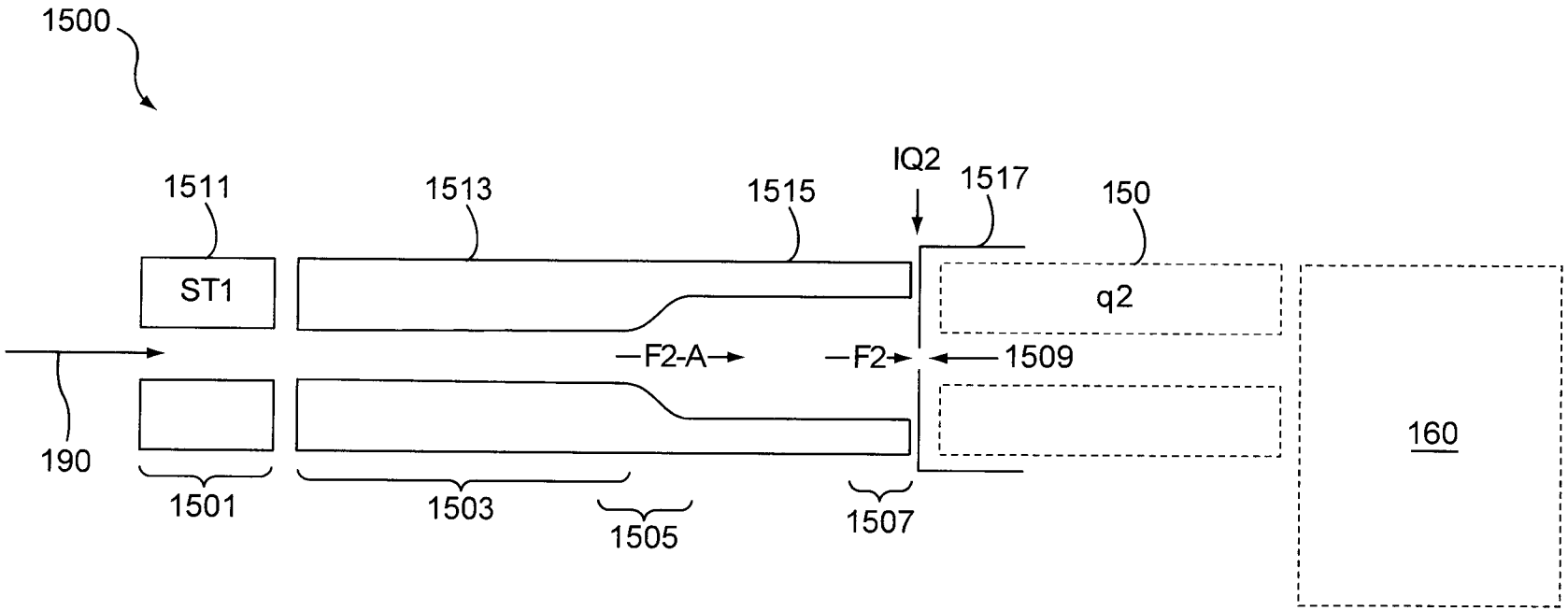
FIGS. 15 to 17 depict block diagrams of linear ion traps for radial amplitude assisted transfer, according to non-limiting implementations.

Attention is now directed to FIG. 15, which depicts a linear ion trap 1500, similar to linear ion trap 200, with like elements having like numbers however preceded by "15" rather than "2". For example, entrance region 1501 is similar to entrance region 201. In linear ion trap 1500, however, linear ion guides 213, 215 have been replaced by a single linear ion guide 1513 which includes a region 1505, also referred to as first axial acceleration region 1505. In these implementations, acceleration of radially excited ions 190 in first axial acceleration region 1505 occurs by providing a difference in RF field in first axial acceleration region 1505 to generate there between a pseudo-potential longitudinal axial force on radially excited ions 190. For example, an RF gradient is provided in first axial acceleration region 1505 as the RF electrodes (e.g. the rods that make up the multipole) have a change in diameter such that a distance between the RF electrodes increases in first axial acceleration region 1505 due a change in shape of the RF electrodes. In depicted implementations in FIG. 15, the RF electrodes are tapered. Hence, a difference in RF field applied between rods of a multipole in linear ion guide 1513 results in region 1505, which results in an axial pseudo-potential longitudinal force F2-A being applied to radially excited ions in region 1505. Hence, the combination of axial force F2-A and axial force F2 enables radially excited ions to overcome the DC potential barrier applied at IQ2 and exit linear ion trap 1500. Furthermore, as unexcited ions do not experience force F2-A or force F2, unexcited ions do not exit linear ion trap 1500.

Figure 16:
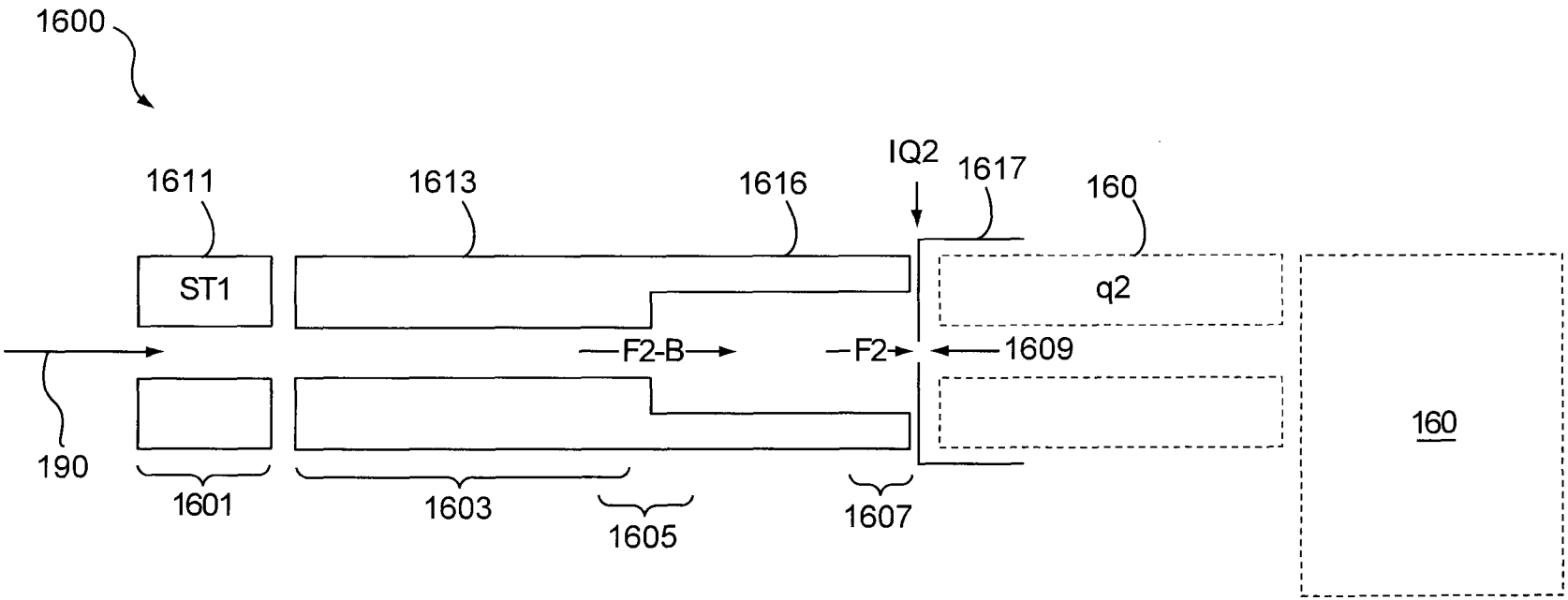

Attention is now directed to FIG. 16, which depicts a linear ion trap 1600, similar to linear ion trap 1500, with like elements having like numbers however preceded by "16" rather than "15". For example, entrance region 1601 is similar to entrance region 1501. However, in linear ion trap 1600 while linear ion guide 1613 is similar to linear ion guide 1513, the RF electrodes (e.g. rods) in linear ion guide 1613 have an abrupt, or stepped, change in diameter in region 1605, which results in an axial pseudo-potential longitudinal force F2-B being applied to radially excited ions in region 1605, similar to axial force F2-A described above. Hence, the combination of axial force F2-B and axial force F2 enables radially excited ions to overcome the DC potential barrier applied at IQ2 and exit linear ion trap 1600. Furthermore, as unexcited ions do not experience force F2-B or force F2, unexcited ions do not exit linear ion trap 1600.

Figure 20:
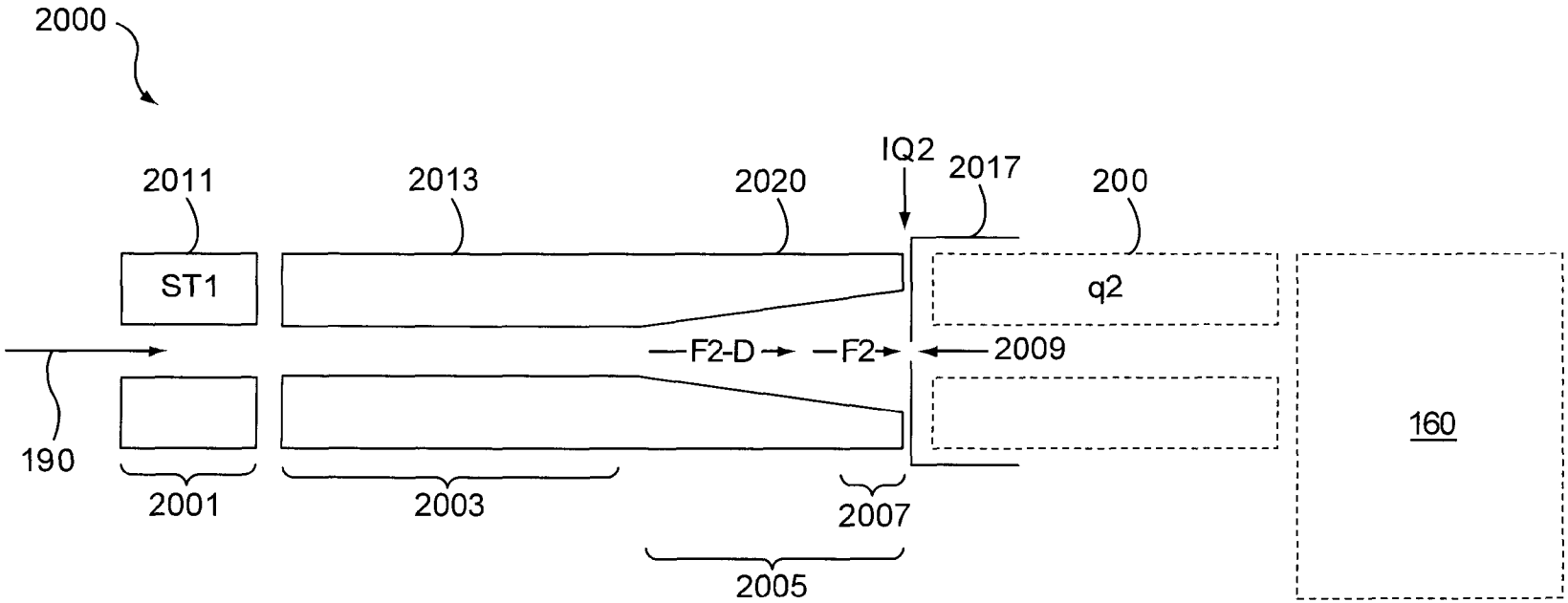
FIG. 20 depicts a block diagrams of a linear ion trap for radial amplitude assisted transfer, according to non-limiting implementations.

Attention is now directed to FIG. 20, which depicts a linear ion trap 2000, similar to linear ion trap 1500, with like elements having like numbers however preceded by "20" rather than "15". For example, entrance region 2001 is similar to entrance region 1501. However, in linear ion trap 2000 while linear ion guide 2013 is similar to linear ion guide 1513, a distance between RF electrodes (e.g. rods) in linear ion guide 2013 increases via a decrease in diameter in region 2005, which results in an axial pseudo-potential longitudinal force F2-D being applied to radially excited ions in region 2005, similar to axial force F2-A described above. Hence, the combination of axial force F2-D and axial force F2 enables radially excited ions to overcome the DC potential barrier applied at IQ2 and exit linear ion trap 2000. Furthermore, as unexcited ions do not experience force F2-D or force F2, unexcited ions do not exit linear ion trap 2000.

Figure 17:
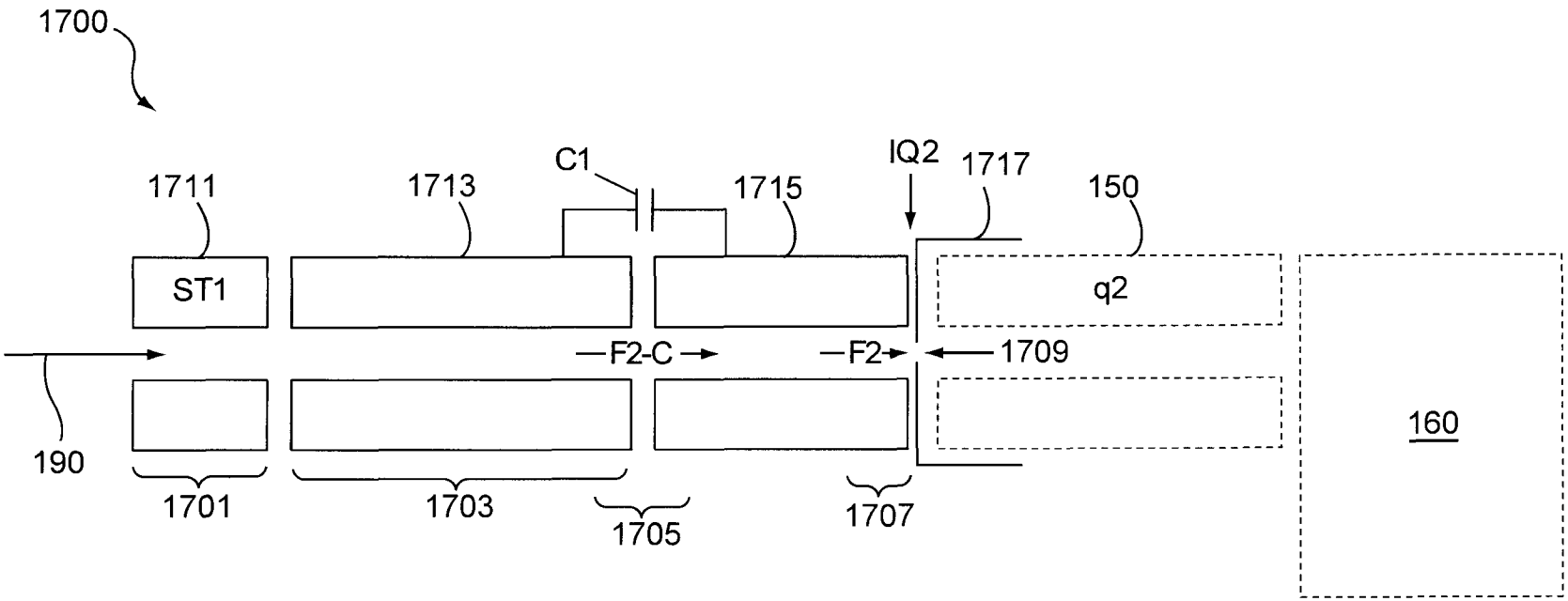

Attention is now directed to FIG. 17, which depicts a linear ion trap 1700, similar to linear ion trap 200, with like elements having like numbers however preceded by "17" rather than "2". For example, entrance region 1701 is similar to entrance region 201. However, in linear ion trap 1700 linear ion guide 1713 is electrically connected to linear ion guide 1715 via a capacitor C1, such that an RF field applied to linear ion guide 1713 will also result in a similar RF field applied to linear ion guide 1715, with however difference in amplitude and/or phase. Such a change in RF field in region 1705 results in an axial pseudo-potential longitudinal force F2-C being applied to radially excited ions in region 1705, similar to axial force F2-A described above. Hence, the combination of axial force F2-C and axial force F2 enables radially excited ions to overcome the DC potential barrier applied at IQ2 and exit linear ion trap 1700. Furthermore, as unexcited ions do not experience force F2-C or force F2, unexcited ions do not exit linear ion trap 1700.

Figure 22:
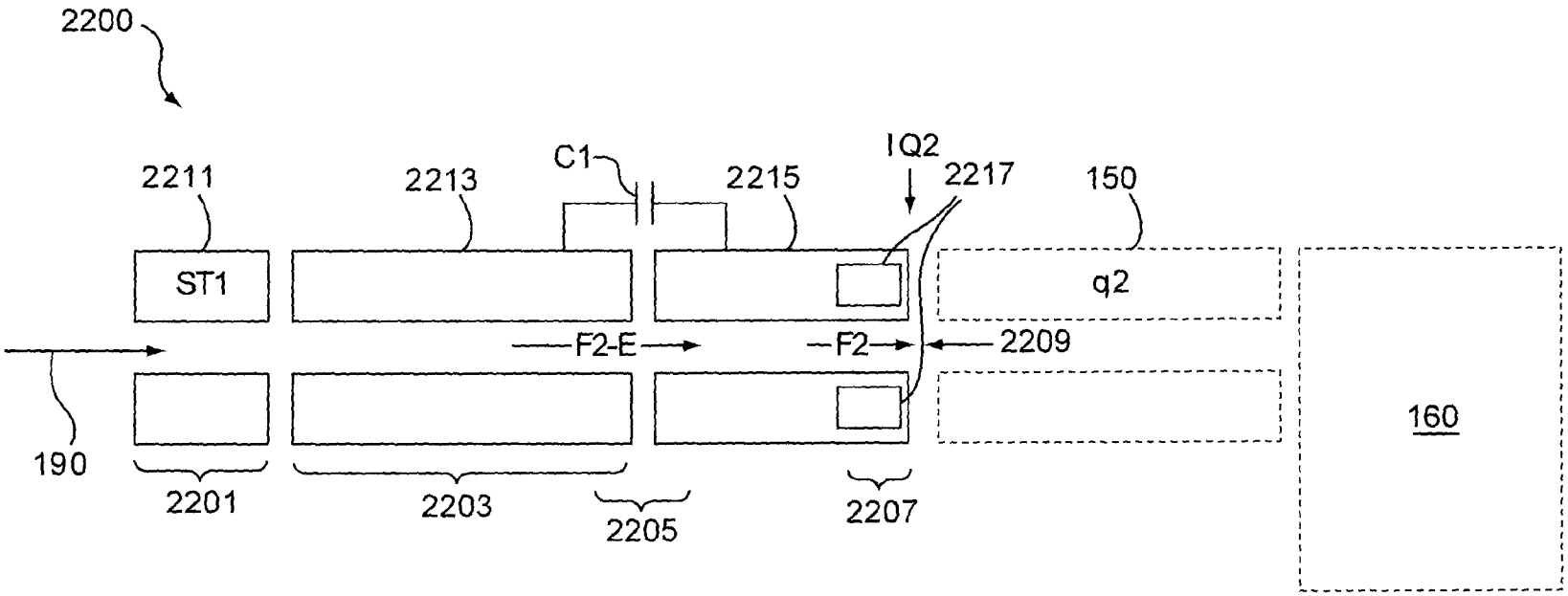
FIGS. 22 to 24 depict block diagrams of linear ion traps for radial amplitude assisted transfer, according to non-limiting implementations.

Attention is now directed to FIG. 22, which depicts a linear ion trap 2200, similar to linear ion trap 1700, with like elements having like numbers however preceded by "22" rather than "17" For example, entrance region 2201 is similar to entrance region 1701. However, in linear ion trap 2200 the DC barrier at IQ2 is produced by auxiliary electrodes 2217 which extend between rods of linear ion guide 2215 from the approximate middle to the approximate end of linear ion guide 2215. In these implementations, F2 acting on excited ions can be much smaller than when the DC barrier at IQ2 is produced by electrode 1717, as F2 is applied to excited ions after excited ions climb the DC barrier created by auxiliary electrodes 2217. Hence, in these implementations, excited ions are differentiated from non-excited ions, with regard to exiting linear ion trap 220, mainly by experiencing force F2-E, similar to force F2-C. Both excited ions and non-excited ions reach the approximate middle of linear ion trap 2215, wherein non-excited ions are repelled back by the action of DC potential applied to auxiliary electrodes 2217. Excited ions acquire sufficient energy from F2-E that they climb over the DC barrier due to auxiliary electrodes 2217. It is appreciated that exit region 2209 in these implementations is proximal to the exit ends of auxiliary electrodes 2217.

It is yet further appreciated that in linear ions guides 1500, 1600, 1700 DC electrodes 1517, 1617, 1717 respectively, can be replaced with auxiliary electrodes similar to auxiliary electrodes 2217 such that forces F2-A, F2B, respectively, in combination with force F2 causes radially excited ions to exit linear ions guides 1500, 1600, 1700.

Figure 24:
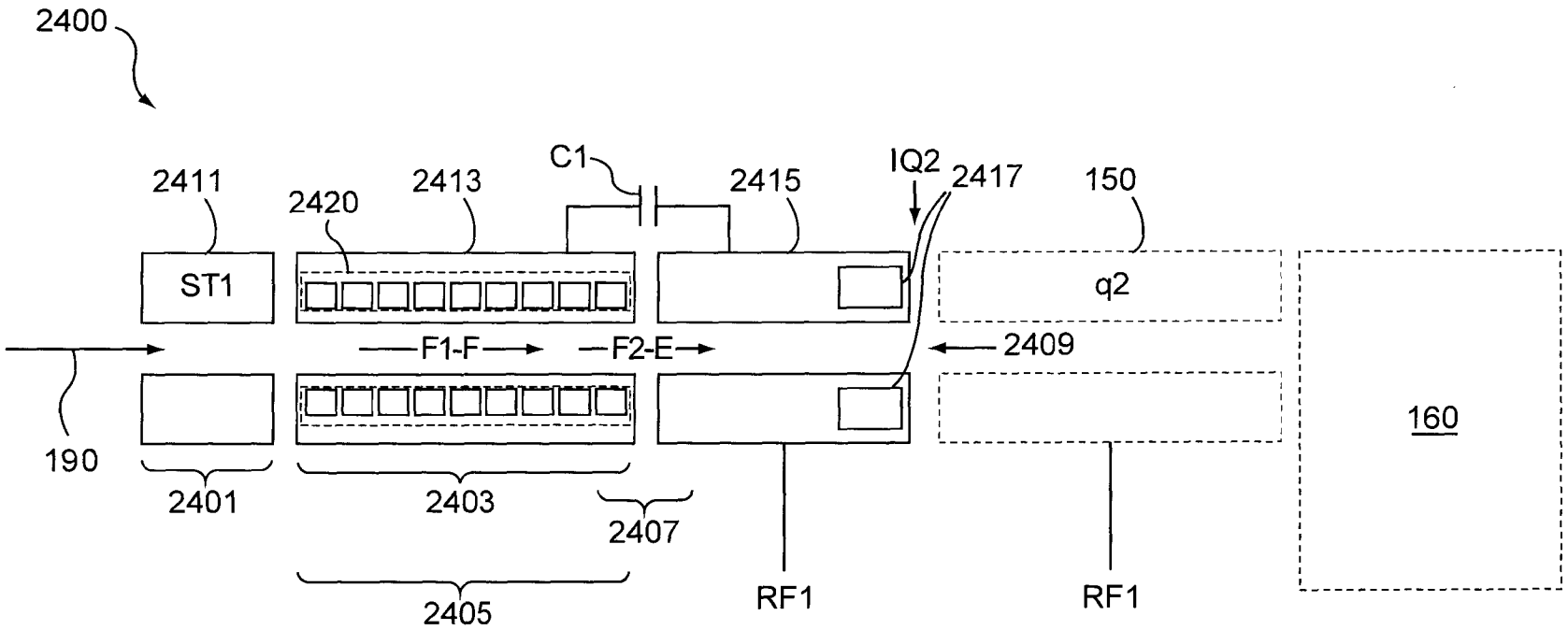

Attention is now directed to FIG. 24, which depicts a linear ion trap 2400, similar to linear ion trap 2200, with like elements having like numbers however preceded by "24" rather than "22" For example, entrance region 2401 is similar to entrance region 2201. However a strength RF1 of the RF field applied to linear ion guide 2415 is the same strength RF1 as the RF field applied to collision cell 150 such that force F2 is no longer present (F2 being due to a change in RF field). To overcome this, linear ion guide 2413 comprise DC electrodes 2420, similar to DC electrodes 920 (and/or DC electrodes 1320), such that force F1-E, similar to force F1-B can be applied to ions 190. Alternatively, DC electrodes 2420 can be replaced with DC electrodes similar to DC electrodes 620 of FIG. 6 such that a longitudinal axial force can be applied to ions 190 and/or ions 190 that are radially excited. It is further appreciated that any other suitable method and/or apparatus for applying a longitudinal axial force in region 2403 is within the scope of present implementations, including but not limited to the segmented linear ion guide 2313 of FIG. 23 and/or resistive coatings on roads of linear ion trap 2413.

In any event, in these implementations, radial acceleration region 2403 comprises first acceleration region 2405, and second acceleration region 2407 is in the transition region between linear ion guides 2413, 2415, second acceleration region 2407 being further away from exit region 2409.

Figure 18:
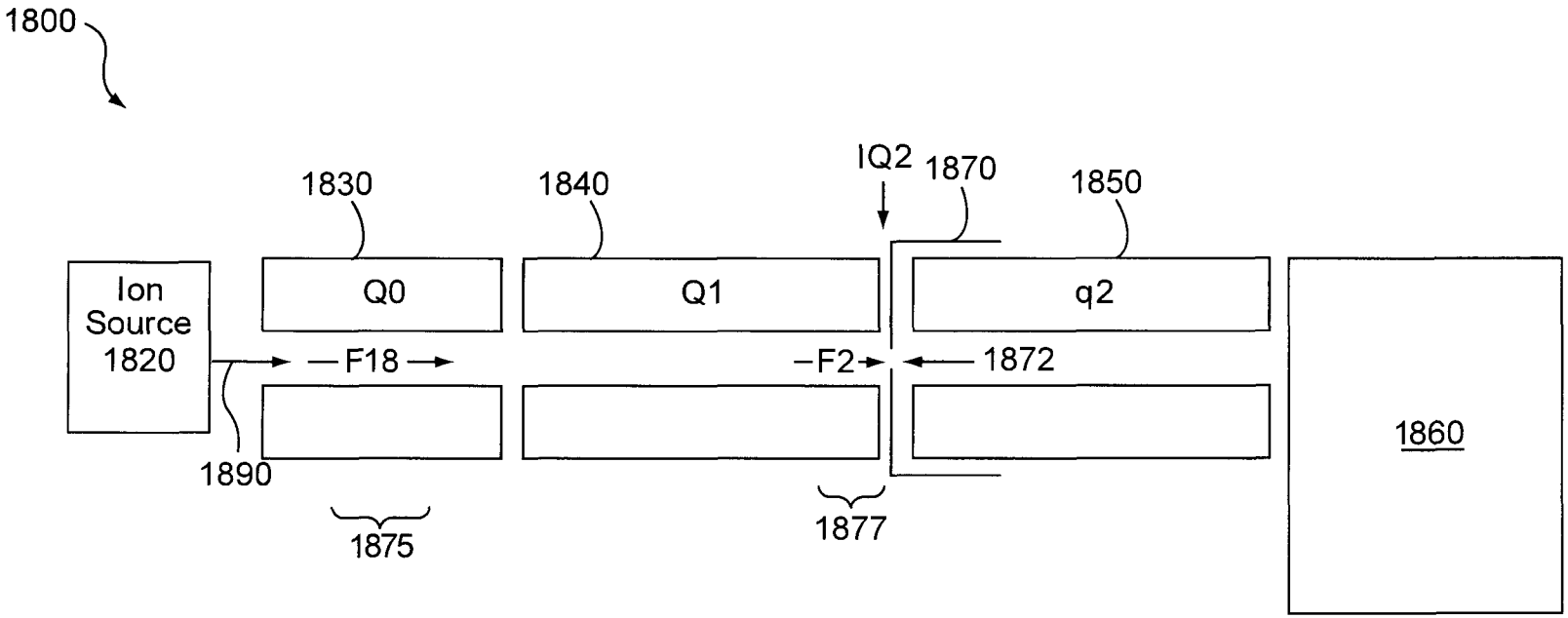
FIG. 18 depicts a block diagram of a mass spectrometer, according to non-limiting implementations.

Attention is now directed to FIG. 18, which depicts a mass spectrometer 1800 mass spectrometer 1800 comprising an ion source 1820, an ion guide 1830, a linear ion trap 1840, a collision cell 1850 (e.g. a fragmentation module) and a detector 1860, mass spectrometer 1800 enabled to transmit an ion beam from ion source 1820 through to detector 1860. In general, mass spectrometer 1800 is similar to mass spectrometer 100. It is appreciated that linear ion trap 1840 comprises any linear ion trap enabled for RAAT and hence an exit electrode 1870, similar to exit electrode 217, is located at an end region 1872 of linear ion trap 184. Hence, as a portion of ions 1890 from ion source 1820 are radially excited in linear ion trap 1840, force F2 is applied to radially excited ions 1890 in second axial acceleration region 1877, similar to axial acceleration region 207 described above.

However radial excitation of ions in linear ion trap 1840 is kept below a threshold such that force F2 is not sufficient to enable radially excited ions to overcome the DC potential of exit electrode 1870. Rather, prior to being injected into linear ion trap 1840, ions 1890 experience a longitudinal axial force F18 in a first acceleration region 1875 due to longitudinal DC potential applied to at least a portion of ions 1890. In depicted implementations, first acceleration region 1875 is located in ion guide 1830 and/or at any other suitable location between ion source 1820 and linear ion trap 1840. Force F18 is also kept below a suitable threshold so that ions 1890 which are not radially excited in linear ion trap 1840 cannot overcome the potential barrier at exit electrode 1870. Rather, only radially excited ions 1890 which experience both force F18 and force F2 can overcome the potential barrier due to exit electrode 1870.

First acceleration region 1875 can be located at any suitable position between ion source 1820 and linear ion trap 1840. Furthermore, axial force F18 can be produced using any suitable apparatus, for example any suitable combination of DC electrodes 620 of FIG. 6, DC electrodes 820 of FIG. 8, DC electrodes 920 of FIG. 9, DC electrodes 1120 of FIG. 11, DC electrodes 1320 of FIG. 13, or the like.

Figure 19:
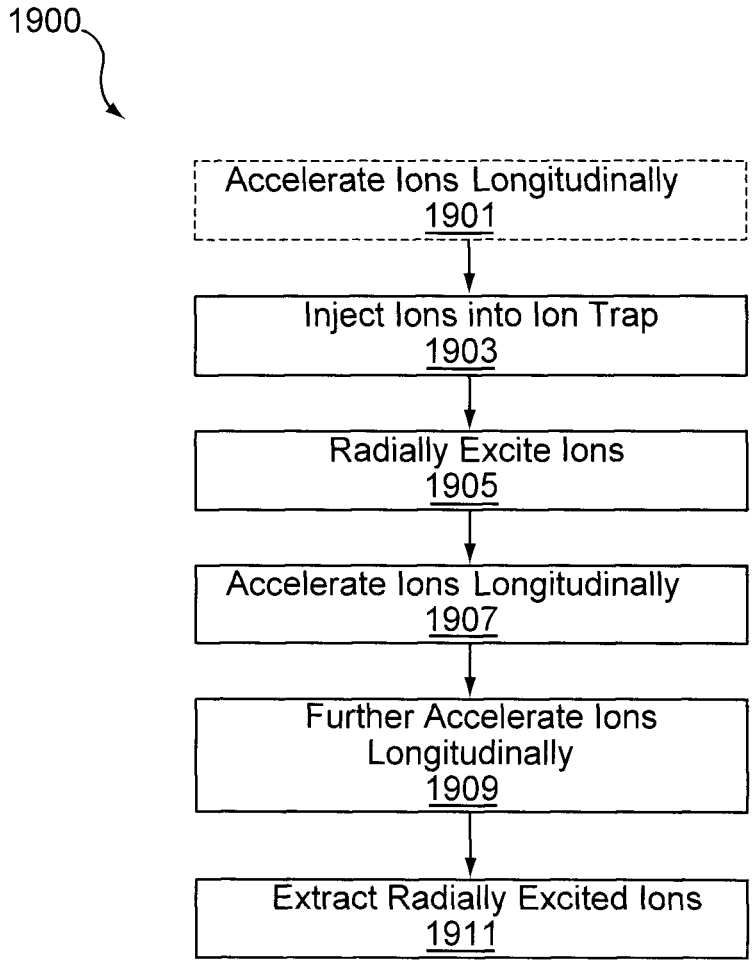
FIG. 19 depicts a flow chart of a method for radial amplitude assisted transfer, according to non-limiting implementations.

Attention is now directed to FIG. 19 which depicts a method 1900 for radial amplitude assisted transfer (RAAT) in a mass spectrometer. In order to assist in the explanation of method 1900, it will be assumed that method 1900 is performed using any one of mass spectrometers 100, 1800 and/or linear ion traps 200, 600, 800, 900, 1100, 1300, 1500, 1600, 1700 or 1800, though the description will make reference to mass spectrometers 100, 1800 and/or linear ion traps 200, 600, 800, 900, 1100, 1300, 1500, 1600, 1700 or 1800 as suited to the given portion of the description. Furthermore, the following discussion of method 400 will lead to a further understanding of mass spectrometers 100, 1800 and/or linear ion traps 200, 600, 800, 900, 1100, 1300, 1500, 1600, 1700 or 1800 and their various components. However, it is to be understood that mass spectrometers 100, 1800 and/or linear ion traps 200, 600, 800, 900, 1100, 1300, 1500, 1600, 1700 or 1800 and/or method 1900 can be varied, and need not work exactly as discussed herein in conjunction with each other, and that such variations are within the scope of present embodiments.

At step 1903, ions 190 are injected from an ion source 120 into a linear ion trap 200 enabled for RAAT, as described above. In some alternative implementations, ions 190 from ion source 120 are accelerated along a longitudinal axis of mass spectrometer 100 prior to being injected into linear ion trap 200 in step 1903, (e.g. as described above with reference to mass spectrometer 1800 and linear ion trap 1820).

At step 1905, at least a portion of ions 190 are radially excited in linear ion trap 200 to produce radially excited ions.

At step 1907, at least one of ions 190 and radially excited ions are accelerated along a longitudinal axis of mass spectrometer. In some implementations one of step 1901 and step 1907 occurs, while in other implementations both of steps 1901 and 1907 occur.

At step 1909 radially excited ions are further accelerated along longitudinal axis due to a pseudo-potential produced by a reduction in RF field strength such that a combination of forces on radially excited ions due to accelerating step 1907 (and/or accelerating step 1901) and further accelerating step 1909 causes radially excited ions to overcome a DC potential barrier at exit region 209 while ions 190 which are not radially excited remain in linear ion trap 200, thereby extracting said radially excited ions at step 1911.

When step 1901 occurs, accelerating occurs prior to radially exciting step 1905, and accelerating step 1901 occurs between ion source 120 and linear ion trap 200.

Accelerating step 1907 can occur by providing a difference in an RF field in linear ion trap 200 prior to exit region 207 to generate there between a pseudo-potential longitudinal axial force on radially excited ions, as in linear ion traps 1500, 1600 and 1700. Accelerating step 1907 (and/or accelerating step 1901) can alternatively occur by providing a longitudinal DC potential on at least one of ions 190 and radially excited ions.

When accelerating step 1907 occurs by providing a difference in an RF field, an RF gradient can be provided by at least one of:

an increasing distance between RF electrodes as in linear ion traps 1500, 1600;

a change in shape of RF electrodes, as in linear ion trap 1500, 1600;

RF electrodes being tapered, as in at least a portion of linear ion trap 1500;

RF electrodes being stepped, as in at least a portion of linear ion trap 1600; and providing linear ion trap 1700 in which first set of RF electrodes 1713 and second set of electrodes 1715, adjacent exit region 1709 are via a circuit which causes difference in RF field.

When accelerating step 1907 (and/or accelerating step 1901) occurs by providing a longitudinal DC potential, the longitudinal DC potential can be provided by increasing a distance between at least one set of DC electrodes 620 or 1120 that extend longitudinally, as in linear ion trap 600 and 1100. Alternatively, the longitudinal DC potential can be provided using a series of opposed DC electrodes 920 or 1320 that extend longitudinally, as in linear ion trap 900 and 1300, series of opposed DC electrodes 620, 1120 for producing the longitudinal DC potential, the series of opposed DC electrodes 620, 1120 independently controlled to apply a longitudinal DC potential to ions 190 as DC potential steps in each successive electrode in the series. In alternative implementations, longitudinal DC potential can be applied to ions in linear ion trap 200 by segmenting the main rodset and applying different DC voltages to different segments, as depicted in FIG. 23. In yet further alternative implementations, longitudinal DC potential can be applied to ions in linear ion trap 200 by utilizing electrodes with resistive coatings. Longitudinal force can also comprise a travelling wave. Indeed, it is appreciated that any suitable method and/or apparatus for applying a longitudinal force is within the scope of present implementations.

In some implementations, extracting radially excited ions from linear ion trap at step 1911 can further comprise applying a first DC potential adjacent to exit region 209 for trapping ions 190 in radial acceleration region 203 of linear ion trap 200 during selective radial excitation, the first DC potential greater than a DC potential in radial excitation region 203, as in FIG. 3. Then, again as in FIG. 3, a second DC potential adjacent to exit region 209 is applied, second DC potential less than first DC potential and less than DC potential in radial excitation region 203, such that ions 190 in radial excitation region 203 are accelerated to exit region 209 and the combination of forces on radially excited ions due to the longitudinal DC potential and pseudo-potential causes radially excited ions to overcome DC potential barrier due to electrode 217. In some implementations, prior to applying the second DC potential, a decreasing DC potential is applied in radial excitation region 203, as in FIG. 7, hence applying an additional accelerating force on radially excited ions.

Hence, by using a combination of a longitudinally axial force (or forces) and the pseudo-potential that occurs in RAAT-enabled linear ion trap, the degree of radial excitation for selectively extracting ions in the RAAT-enabled linear ion trap can be reduced, thereby decreasing the angle of extraction of the RAAT-enabled linear ion trap an increasing the extraction efficiency.

Persons skilled in the art will appreciate that there are yet more alternative implementations and modifications possible for implementing the implementations, and that the above implementations and examples are only illustrations of one or more implementations. The scope, therefore, is only to be limited by the claims appended hereto.

What is claimed is:

1. A mass spectrometer for radial amplitude assisted transfer (RAAT), said mass spectrometer comprising:

an ion source;

a first axial acceleration region for axially accelerating at least a portion of said ions from said ion source along a longitudinal axis of said mass spectrometer;

at least one linear ion trap arranged to receive said ions from said ion source, said at least one linear ion trap comprising:

an entrance region for receiving said ions therein;

an exit region for transferring radially exited ions out of said at least one linear ion trap;

at least one DC (direct current) electrode for applying a DC potential barrier to prevent unexcited ions from exiting said at least one linear ion trap;

a radial excitation region between said entrance region and said exit region for selective radial excitation of said ions trapped in said at least one linear ion trap thereby producing said radially excited ions;

a second axial acceleration region for further accelerating said radially excited ions along said longitudinal axis towards said exit region due to a pseudo-potential produced by a reduction in RF field strength, such that said a combined effect of forces on said radially excited ions due to said first axial acceleration region and said second axial acceleration region causes said radially excited ions to overcome said DC potential barrier while said unexcited ions which are not radially excited remain in said at least one linear ion trap; and a detection device for receiving and analyzing at least a portion of said radially excited ions that exit said at least one linear ion trap.

2. The mass spectrometer of claim 1, wherein said first axial acceleration region is located in at least one of:

between said ion source and said at least one linear ion trap, acceleration in said first axial region occurring by providing a longitudinal DC potential to said at least a portion of said ions, said at least one linear ion trap, prior to said exit region, acceleration in said first axial region occurring by at least one of:

providing a difference in said RF field in said first axial acceleration region to generate there a pseudo-potential longitudinal axial force on said radially excited ions; and providing a longitudinal DC potential in said first axial acceleration;

between said radial excitation region and said exit region, said at least one linear ion trap comprising a first set of RF electrodes in said radial excitation region and a second set of electrodes in said first acceleration region, said second set RF electrodes electrically connected to said first set of RF electrodes via a circuit which causes a change in said RF field between said radial excitation region and said first acceleration region such that said difference in said RF field is caused by said change; and between said radial excitation region and said end trap, wherein said providing said difference in longitudinal DC potential in said first axial acceleration region comprises:

applying a first DC potential in said first axial acceleration region for trapping said ions in said radial acceleration region during selective radial excitation, said first DC potential greater than a DC potential in said radial excitation region; and, applying a second DC potential in said first axial acceleration region less than said first DC potential and less than said DC potential in said radial excitation region, such that ions in said radial excitation region are accelerated through said first axial acceleration region and said combination of forces on said radially excited ions due to said longitudinal DC potential and said pseudo-potential causes said radially excited ions to overcome said DC potential barrier, and wherein said radial excitation region comprises at least one set of RF electrodes for producing said radially excited ions and at least one set of DC electrodes for providing a decreasing DC potential, and wherein, prior to applying said second DC potential, said decreasing DC potential is applied in said radial excitation region hence applying an additional accelerating force on said radially excited ions.

3. The mass spectrometer of claim 2, wherein said at least one ion trap comprises RF electrodes, a radial distance between said RF electrodes increasing in said first axial acceleration region such that said providing said difference in said RF field occurs due to a change in said distance;

wherein said distance between said RF electrodes is due to a change in shape of said RF electrodes; and wherein said RF electrodes are at least one of:

decreasing in diameter in said first axial acceleration region;

tapered in said first axial acceleration region; and stepped in said first axial acceleration region.

4. The mass spectrometer of claim 2, wherein said providing said difference in said RF field comprises providing an RF gradient in said first acceleration region, and wherein said second axial acceleration region is located at least one of:

adjacent to said exit region, said at least one DC electrode located adjacent to said exit region, and;

wherein said second axial acceleration region is located between said first acceleration, and said exit region said at least one DC electrode located between said first acceleration and said exit region.

5. The mass spectrometer of claim 2, wherein said radial excitation region comprises at least one set of RF electrodes for producing said radially excited ions and at least one set of DC electrodes for providing said longitudinal DC potential, said wherein said second axial acceleration region is adjacent to said exit region, said at least one DC electrode located adjacent to said exit region; and wherein a distance between said at least one set of DC electrodes increases from an entrance end of said DC electrodes to an exit end of said DC electrodes thereby providing said longitudinal DC potential; and wherein each of said at least one set of DC electrodes comprises a series of opposed DC electrodes for producing said longitudinal DC potential, said series of opposed DC electrodes independently controlled to apply said longitudinal DC potential to said ions as DC potential steps in each successive electrode in said series.

6. The mass spectrometer of claim 1, wherein said radial excitation region comprises at least one of:

said first axial acceleration region, a longitudinal axial force on said radially excited ions due to segmented RF electrodes in said radial excitation region, said segmented RF electrodes each having a respective applied DC voltage which decreases from an entrance end of said radial acceleration region to an exit end of said radial acceleration region; and said first axial acceleration region, a longitudinal axial force on said radially excited ions due to resistive coatings on RF electrodes in said radial excitation region.

7. The mass spectrometer of claim 1, wherein said at least one linear ion trap is enabled to produce said radially excited ions via at least one of:

an AC (alternating current) field;

bringing an RF voltage near an instability threshold for selected ions; and increasing said RF voltage to or above the instability threshold for a duration of excitation and then lowering said RF voltage.

8. The mass spectrometer of claim 1, wherein said second axial acceleration region is at least one of adjacent to said exit region and before said exit region.

9. A method for radial amplitude assisted transfer (RAAT) in a mass spectrometer, said method comprising:

producing ions in an ion source;

axially accelerating at least a portion of said ions along a longitudinal axis of said mass spectrometer, in a first axial acceleration region; and applying a pseudo-potential in a second axial acceleration region to radially excited ions in an ion trap, said pseudo-potential produced by a reduction in RF field strength, such that a combined effect of forces on said radially excited ions due to said first axial acceleration region and said second axial acceleration region causes said radially excited ions to overcome a DC (direct current) potential barrier while unexcited ions which are not radially excited remain in said at least one linear ion trap, said linear ion trap arranged to receive said ions from said ion source, said at least one linear ion trap comprising: an entrance region for receiving said ions therein; an exit region for transferring radially exited ions out of said at least one linear ion trap, at least one DC electrode for applying said DC potential barrier to prevent said unexcited ions from exiting said at least one linear ion trap; a radial excitation region between said entrance region and said exit region for selective radial excitation of said ions trapped in said at least one linear ion trap thereby producing said radially excited ions;

and analyzing at least a portion of said radially excited ions at a detection device.

10. The method of claim 9, wherein said at least one linear ion trap is enabled to produce said radially excited ions via at least one of:

an AC (accelerating current) field;

bringing an RF voltage near an instability threshold for selected ions; and increasing said RF voltage for a duration of excitation and then lowering said RF voltage.

11. A method for radial amplitude assisted transfer (RAAT) in a mass spectrometer, said method comprising:

injecting ions from an ion source into a linear ion trap enabled for RAAT;

radially exciting at least a portion of said ions to produce radially excited ions in said linear ion trap;

accelerating at least one of said ions and said radially excited ions along a longitudinal axis of said mass spectrometer, wherein said accelerating occurs at least one of prior to said radially exciting step and after said radially exciting step; and further accelerating said radially excited ions along said longitudinal axis due to a pseudo-potential produced by a reduction in RF field strength, such that a combination of forces on said radially excited ions due to said accelerating step and said further accelerating causes said radially excited ions to overcome a DC potential barrier and exit said linear ion trap while said ions which are not radially excited remain in said linear ion trap.

12. The method of claim 11, wherein when said accelerating step occurs prior to said radially exciting step, and wherein said accelerating step further occurs between said ion source and said linear ion trap.

13. The method of claim 11, wherein said providing said longitudinal DC potential occurs by increasing a distance between at least one set of DC electrodes that extend longitudinally in said linear ion trap.

14. The method of claim 11, wherein said accelerating step occurs by at least one of:

providing a difference in an RF field in said linear ion trap prior to said exit region to generate there between a pseudo-potential longitudinal axial force on said radially excited ions;

providing a longitudinal DC potential on said at least one of said ions and said radially excited ions, and wherein said providing said difference in said RF field comprises providing an RF gradient by at least one of:

an increasing radial distance between RF electrodes in said linear ion trap;

a change in shape of said RF electrodes;

a decrease in diameter of said RF electrodes in at least a first portion of said linear ion trap;

said RF electrodes being tapered in at least a second portion of said linear ion trap;

said RF electrodes being stepped in at least a third portion of said linear ion trap; and said linear ion trap comprising a first set of RF electrodes and at least a second set of electrodes adjacent said exit region, said second set RF electrodes electrically connected to said first set of RF electrodes via a circuit which causes said difference in said RF field.

15. The method of claim 11, wherein said providing said longitudinal DC potential occurs by providing a series of opposed DC electrodes that extend longitudinally in said linear ion trap, said series of opposed DC electrodes for producing said longitudinal DC potential, said series of opposed DC electrodes independently controlled to apply said longitudinal DC potential to said ions as DC potential steps in each successive electrode in said series.

16. The method of claim 11, wherein said radial excitation region comprises said first axial acceleration region, a longitudinal axial force on said radially excited ions due to segmented RF electrodes in said radial excitation region, said segmented RF electrodes each having a respective applied DC voltage which decreases from an entrance end of said radial acceleration region to an exit end of said radial acceleration region.

17. The method of claim 11, wherein said radial excitation region comprises said first axial acceleration region, a longitudinal axial force on said radially excited ions due to resistive coatings on RF electrodes in said radial excitation region.

18. The method of claim 11, further comprising extracting said radially excited ions from said linear ion trap by:

applying a first DC potential adjacent said exit region for trapping said ions in a radial acceleration region of said linear ion trap during selective radial excitation, said first DC potential greater than a DC potential in said radial excitation region; and, applying a second DC potential adjacent said exit region, said second DC potential less than said first DC potential and less than said DC potential in said radial excitation region, such that ions in said radial excitation region are accelerated to said exit region and said combination of forces on said radially excited ions due to said longitudinal DC potential and said pseudo-potential causes said radially excited ions to overcome said DC potential barrier.

19. The method of claim 18, further comprising, prior to applying said second DC potential, applying a decreasing DC potential in said radial excitation region hence applying an additional accelerating force on said radially excited ions.

20. A mass spectrometer for radial amplitude assisted transfer (RAAT), said mass spectrometer comprising:

an ion source;

at least one linear ion trap arranged to receive said ions from said ion source, said at least one linear ion trap comprising:

an entrance region for receiving said ions therein;

an exit region for transferring radially exited ions out of said at least one linear ion trap;

at least one DC (direct current) electrode for applying a DC potential barrier to prevent unexcited ions from exiting said at least one linear ion trap;

a radial excitation region between said entrance region and said exit region for selective radial excitation of said ions trapped in said linear ion trap thereby producing radially excited ions via application of an AC (alternating current) field;

an axial acceleration region between said radial excitation region and an exit of said at least one linear ion trap, said axial acceleration region for axially accelerating at least a portion of said ions from said ion source along a longitudinal axis of said mass spectrometer by providing a difference in said RF field in said axial acceleration region to generate there a pseudo-potential longitudinal axial force on said radially excited ions, said difference in said RF field provided by an RF gradient from least one of:

an increasing distance between RF electrodes in said at least one linear ion trap;

a change in shape of said RF electrodes;

a decrease in diameter of said RF electrodes in at least a first portion of said linear ion trap;

said RF electrodes being tapered in at least a second portion of said linear ion trap;

said RF electrodes being stepped in at least a third portion of said linear ion trap; and said linear ion trap comprising a first set of RF electrodes and at least a second set of electrodes adjacent said exit region, said second set RF electrodes electrically connected to said first set of RF electrodes via a circuit which causes said difference in said RF field; and at least one electrode between said radial excitation region and said exit for providing a DC (direct current) potential barrier to prevent said unexcited ions from reaching said exit, said pseudo-potential longitudinal axial force on said radially excited ions for overcoming said DC potential barrier such that said radially excited ions overcome said DC potential barrier and exit said at least one ion trap; and a detection device for receiving and analyzing at least a portion of said radially excited ions that exit said at least one ion trap.

* * * * *